US006082153A

United States Patent [19]

Schoell et al.

[11] Patent Number: 6,082,153

[45] Date of Patent: Jul. 4, 2000

[54] ANTI-TAMPERING DEVICE FOR USE WITH SPRING-LOADED ELECTRONICALLY MOVED PIN LOCKING MECHANISMS IN ELECTRONIC LOCKS AND THE LIKE

[75] Inventors: Lance G. Schoell; Matthew O. Schroeder, both of Roanoke; Barton B. Cregger, Richmond, all of Va.

[73] Assignee: Medeco Security Locks, Inc., Salem, Va.

[21] Appl. No.: 09/004,919

[22] Filed: Jan. 9, 1998

Related U.S. Application Data

[63] Continuation-in-part of application No. 08/931,887, Sep. 17, 1997, abandoned.

[51] Int. Cl.[7] ..... E05B 47/06

[52] U.S. Cl. ..... 70/1.5; 70/278.3; 70/278.7; 70/283; 70/333 R; 70/416; 292/144

[58] Field of Search ..... 70/1.5, 333 R, 70/416, 278.2, 278.3, 278.7, 283, 283.1; 292/144

[56] References Cited

U.S. PATENT DOCUMENTS

| | | | |
|---|---|---|---|
| 2,421,917 | 6/1947 | Williams . | |
| 3,231,180 | 1/1966 | Wellekens . | |
| 4,470,275 | 9/1984 | Fisher | 70/1.5 |
| 4,520,736 | 6/1985 | Crosby et al. | 70/1.5 X |
| 4,848,115 | 7/1989 | Clarkson et al. | 70/278.2 X |
| 5,552,777 | 9/1996 | Gokcebay et al. | 340/825.31 |
| 5,614,892 | 3/1997 | Ward, II et al. | 340/870.02 |
| 5,819,563 | 10/1998 | Bianco | 70/278.3 |
| 5,839,306 | 11/1998 | Nunuparov | 70/283 |

FOREIGN PATENT DOCUMENTS

| | | |
|---|---|---|
| 396634 | 6/1933 | Belgium . |
| 148701 | 7/1985 | European Pat. Off. . |
| 758120 | 2/1997 | European Pat. Off. . |
| 839865 | 4/1939 | France . |
| 3406913 | 9/1985 | Germany . |
| 4114508 | 11/1991 | Germany . |
| WO91/19068 | 12/1991 | WIPO . |
| WO/9421089 | 9/1994 | WIPO . |

OTHER PUBLICATIONS

Annex to the Invitation to Pay Additional Fees of PCT/US 98/19130.

*Primary Examiner*—Lloyd A. Gall
*Attorney, Agent, or Firm*—Rothwell, Figg, Ernst & Kurz

[57] ABSTRACT

An anti-tamper locking assembly for locking a position of a block, such as a locking bolt in an electronic lock, electrically moves a pin to engage or dis-engage the block. When dis-engaged, the block can be moved and access or the like can be made. The pin is selectively moved electronically in order to allow access, entry or the like. The pin can be moved with, e.g., a solenoid. The pin has an overhanging portion, or a head portion. In order to prevent an individual from forcing the pin into an un-locked position, the head portion operates in conjunction with at least one spring-arm member and a blocker which are fixed to the block to prevent a user from being able to strike the device with a hammer or the like to "temporarily" move the pin to a position allowing the block to be moved and access or the like to be made.

25 Claims, 18 Drawing Sheets

ANTI-TAMPERING DEVICE FOR USE WITH SPRING-LOADED ELECTRONICALLY MOVED PIN LOCKING MECHANISMS IN ELECTRONIC LOCKS AND THE LIKE

This application is a continuation-in-part of U.S. patent application Ser. No. 08/931,887, filed Sep. 17, 1997, to Cregger et al., for Electronic Lock For Parking Meters, now abandoned.

BACKGROUND OF THE INVENTION

1. Field of the Invention

The present invention relates generally to spring loaded solenoid and the like devices that might be overcome by external forces, and in more specific embodiments to electronic locks having spring loaded solenoids and the like that might be overcome by external forces.

This invention also relates generally to electronic security systems, and more particularly to electronic security systems for money-containing devices in telephone chassis, vending machines, parking meters and the like which must be periodically accessed by a collector in order to retrieve the funds accumulated in the device.

2. Description of the Background Art

Typically, in devices having electronically activated solenoids which contain a spring biased element, such as a pin, that is moved when the solenoid is energized, the spring biased element can potentially be moved by subjecting the solenoid to rapid acceleration or external forces. As a result, the spring biased element can potentially be moved relative to the solenoid housing and, thus, create a temporary situation similar to having the solenoid in an "activated" condition.

In electronic locks having a solenoid member that is used to allow access only upon an appropriate electronic determination that access is appropriate, there remains the possibility that an individual can tamper with the lock in a manner to cause the solenoid element to move relative to the solenoid housing and create a condition under which the solenoid is temporarily in an activated condition.

For example, vending machine locks, telephone chassis locks, parking meter locks and locks in other devices can be subjected to forces—such as striking via a hammer—that can cause a rapid acceleration sufficient to cause the solenoid to move relative to the solenoid element, or solenoid pin. Electrically locked enclosures that are mounted in a manner that can allow movement of the enclosure, and the lock itself, are susceptible to tampering. For example, a less rigidly mounted telephone chassis could potentially be moved to enable tampering with the device. Electrically locked enclosures that are non-fixed, free hanging or pole mounted, etc., can be particularly susceptible to such tampering. For example, electronic parking meter locks are susceptible to tampering because electronic parking meter locks are typically contained within relatively small metal housings located upon metal poles. As a result, these housings are relatively easily accessed, handled and/or tampered with.

The collection of money from coin or currency operated devices such as telephone chassis, parking meters and the like is a costly and burdensome operation. For instance, a company may own tens or even hundreds of thousands of locked enclosures for which tens or hundreds of keys must be kept in order to prevent the loss of a key from requiring the changing of locks on thousands of devices which would operate with the lost key. Accordingly, it is particularly desirable to establish a system under which these locked enclosures can be "electronically" accessed and monitored, while maintaining high theft-deterrence to avoid large scale problems that could otherwise be difficult to handle due to the large numbers and various locations of such devices.

A significant problem involved with the collection of funds from currency operated devices is the possibility of fraud or theft by the collector himself. Typically, a collector should remove a full and locked coin box from the device and replace it with an empty coin box to which he does not have access. However, it is possible that a removed coin box will not be replaced with another lock box but rather will be replaced with an unsecured receptacle which can be later removed by that collector before turning in his key at the end of the collection shift. Yet another cost involved in the collection process is the sheer manpower required for the task of distributing, collecting, and keeping track of many keys on a daily basis. Therefore, it is highly desirable to have an electronically controlled access; however, it is also critical to employ means that ensure that such electronic control cannot be overcome by tampering.

Although electronic security systems are known and have been used for various purposes, see e.g. U.S. Pat. Nos. 4,789,859, 4,738,334, 4,697,171, 4,438,426, the existing art does not adequately address the problems noted above. There still remains a need for an improved anti-tampering device for electronic solenoids having spring-biased elements, such as used in electronic locks for vending machines, telephones, parking meters and the like.

BACKGROUND ART IN CO-PENDING APPLICATIONS

The following description is incorporated herein from currently pending U.S. Patent applications to present a complete view of the background upon which the present invention improves, and some of the preferred applications for the present invention.

FIGS. 1A and 1B illustrate an electronic key 100 according to one embodiment. The key has a key body 101 which contains logic and power transfer circuitry, and a key blade 102 with appropriately cut key bits for operating pin tumblers as is known in the art. The key 100 also carries a spring loaded data and power electrical contact 103, which is made of a suitable material and is preferably gold plated.

Portable battery and logic housing 104 contains a battery power supply and electronic circuitry, a battery charging port 105, a wrist strap or belt clip 106, and a plug-connected cable 107 for transferring power and data signals between the housing 104 and the key body 101.

FIG. 1B is an end view of the key body showing the orientation of the spring loaded contact 103 with relation to the key blade 102. The key 100 and connected housing 104 with their components are portable and are referred to as "key means".

FIG. 2 illustrates a lock cylinder and bolt mechanism included in a housing 201 (with its cover removed). Description of this lock cylinder and bolt mechanism is for illustrative purposes. The device shown in FIGS. 13–14, involves a lock that can be operated in a similar manner—e.g., with a similar electronic control. As shown in FIG. 2, within the housing is a bolt 202 operated by a lock cylinder 203 containing a key cylinder plug 204 having a keyway 205 for key blade 102, and an electrical contact 206 which makes contact with the power and data contact 103 of the key body when the key blade 102 is inserted into the key blade opening 205.

A bolt cam 207 is rotated by the lock cylinder 203 to move the bolt 202 between the locked position shown and an unlocked position in which the bolt is withdrawn downward to be substantially within the housing 201. The lock housing 201 further includes electronic logic circuitry 208 and an electrically powered solenoid 209. Solenoid 209 includes a spring biased bolt blocking plunger 210 which, when extended, prevents bolt 202 from being withdrawn by the bolt cam into the housing 201 to its unlocked position. Upon operation of the solenoid 209, bolt blocking plunger 210 is retracted toward the solenoid to enable the key 100 to be turned in the clockwise direction which rotates bolt cam 207 against the bolt 202 and causes the movement of the bolt 202 downward into the housing 201.

FIG. 3 illustrates a programmer for writing data into and reading data from the circuitry in key body 104 through cable 107. The programmer includes a host computer 301 which may be a minicomputer, personal computer, or any other type of computer, but which preferably is an IBM® compatible microcomputer. A key programmer interface unit 302 is connected to the computer 301 by means of a cable 303 which plugs into a communication port of the computer 301. The programmer interface unit 302 contains a key receptacle 304 having electrical contacts into which the plug end of the key cable 107 is inserted after being disconnected from key body 101 to allow the computer to write into the memory within key housing 104. The computer 301 is loaded with a software program 305 for loading and retrieving files from the key logic housing 104.

FIG. 4 illustrates a portable programmer interface unit 401 including a modem which enables the portable programmer interface unit 401 to communicate with the computer 301 through the public switched telephone network (PSTN) via a standard phone jack 402. In this embodiment, an operator in the field needing to update the contents of files in the key housing 104 would dial up the host computer using a standard phone set 403 which is connectable via a jack to the programmer interface 401. Once communication with the host computer 301 is established, the programmer interface unit 401 operates in the same manner as the office programmer interface unit 302.

FIG. 5 is a schematic block diagram illustrating the components within the electronic key housing 104. The components include a microcontroller or microprocessor 501, an electrically erasable programmable read only memory (EEPROM) 502 coupled to the controller 501, an oscillator or clock 503 which provides clock signals for the operation of controller 501, and a battery power source 504 which operates the controller 501 as well as the solenoid 209 and the circuitry 208 within the lock mechanism housing 201. The electronic key components further include an electronic switch 505 operated by the controller 501 and a power sensing circuit 506.

FIG. 6 is a schematic block diagram of the electronic circuitry 208 within the lock housing 201. This circuitry includes a microprocessor 601, an EEPROM 602 coupled to the microprocessor 601, an oscillator or clock 603 for providing operational clock signals to the microprocessor 601, a power filter 604, electronic switch 605 and load 606 for transmission of signals to the key controller 501 via line 607, and an electronic switch 608 for allowing power to flow from power source 504 within the key housing 104 through cable 107 and contacts 103–206 through the solenoid 209 to ground to activate the solenoid.

FIG. 7 is a schematic diagram of the electronic key programmer interface unit 302. It is noted that the portable key programmer interface unit 401 contains substantially the same components as the programmer 302, in addition to the modem and telephone jack not shown. The programmer interface unit 302 includes a microcontroller 701, a clock oscillator 702, an electronic switch 703 and load 704 combination which operate similarly to the switch 605 and load 606, a power supply 705, and a standard RS-232 receiver and driver 706 which couples the programmer interface unit 302 to the host computer 301.

The operation of the system components will now be described with reference to FIGS. 5–7.

The electronic key 100 is inserted into the key programmer interface unit 302 or 401 to be programmed by the host computer running the customized software application 305 via cable 107 as described above.

Using the example of a lock for pay telephones for illustration, the EEPROM 502 is loaded with data corresponding to a specific collection route. The data can be entered manually through a keyboard provided with the host computer 301, or the data can be transferred to the EEPROM 502 from files on a floppy disk inserted into a standard floppy disk drive of the computer 301.

EEPROM 502 is loaded with specially encrypted data corresponding to specific ID codes stored in each of the electronic lock memories 602 of the locks on the specific collection route. Data encryption is performed by an encryption algorithm in a known manner. EEPROM 502 also is loaded with the date of key programming, the start date as of which the key is valid, and a time window during which the key can be used, for example, 24 , 48 or 72 hours from the start date. EEPROM 502 also contains an address location storing the particular key category, for example, whether the key is a collection key or service key, and a serial number for key identification. The data is encrypted using a specific algorithm performed by the software 305.

The computer 301 may also print out the particular collection route, lock key codes, time window, and start date for confirmation by the programmer.

Controller 501 keeps track of the current time and date by counting the clock inputs of oscillator 503 and using the key programming date as a reference.

The data is written into EEPROM 502 through switching of electronic switch 703 by microcontroller 701 which serves to increase and decrease the amount of power consumed by the load 704 which in turn provides the logic levels for binary "1" and "0" digital communication to the microcontroller 501. This increase and decrease in power is sensed by the power sense circuit 506 and is converted into digital signals readable by the microcontroller 501.

Referring now to FIG. 6, the lock mechanism microprocessor 601 is coupled to EEPROM memory 602 which stores a specific ID code for that specific lock. One important feature of the device is that the lock mechanism of FIG. 2 contains no power supply itself but is completely powered by the power source 504 of the electronic key 100. Power filter 604 is provided to supply power to the logic circuits from the key 100 over line 607, the power filter smoothing the voltage waveform so that power interruptions caused by data transmission over line 607 will not affect the operation of the logic circuits.

As an additional security feature, a solenoid activation switch 609 can be mechanically coupled to the bolt blocking plunger 210 of FIG. 2 to detect the retraction of the bolt blocking plunger. In telephones equipped with a so-called "Smart Terminal" or circuit board 610, which is provided with a modem to link the telephone to the host computer over a telephone line, activation switch 609 can be used to send an alarm to the host computer when switch 609 detects the retraction of the bolt blocking plunger in the absence of generation of an enable signal by the microprocessor 601, which would be indicative of someone tampering with the lock by trying to manually pry the bolt blocking plunger away from bolt 202. An additional line 611 may be provided to establish communication between the lock microprocessor and the smart terminal 610.

The use of a smart telephone terminal 610 also allows the use of a host confirmation feature as an additional feature of the present invention. Part of the data stored in the key memory 502 is the key's particular serial number. Using the host confirmation feature, the host computer 301 would dial up the smart terminal 610 via a modem and transmit a host confirmation message to the microprocessor 601. The message may instruct the microprocessor to allow the solenoid 209 to be powered by any mechanically operable key inserted into the key slot 205, may instruct the microprocessor 601 to prevent any key at all from operating the lock by prohibiting powering of the solenoid 209, or may instruct the microprocessor 601 to allow only a key having a particular serial number, transmitted by the host computer, to operate the lock by powering the solenoid. The host confirmation data may then be stored in the memory 602 coupled to the microprocessor 601.

Referring now to FIG. 8, the overall operation of the electronic lock system will be described.

After the key blade 102 is inserted into the keyway 205 and the contact 103 is electrically coupled to the key cylinder contact 206, the electronic lock logic circuitry is powered up or awakened at step 801. At step 802, microprocessor 601 communicates with the microcontroller 501 to read the data stored in the memory 502. At step 803, microprocessor 601 checks whether the current date stored in memory 502 is after the start date written into memory 502 during the programming mode of the key, determines whether the current time read from memory 502 is within the time window stored in memory 502 which has been programmed by the host computer in advance. If the start date read from the key memory is subsequent to the current date read from the key memory, or if the current time is outside of the time window stored in the key memory, the microprocessor advances to step 809 at which the key is determined to be invalid, the microprocessor 601 is reset, and no further action is taken. If the time and date data is valid, the microprocessor 601 proceeds to step 804 in which the list of ID codes stored in key memory 502, corresponding to the locks that key 100 is to operate on this particular collection route, is compared with the current ID code stored in the memory 602. If the ID code in memory 602 is contained in the list stored in memory 502, the process proceeds to step 805 in which the presence of a host confirmation feature is checked. If not, the microprocessor proceeds to step 809. If the telephone is not equipped with a smart terminal 610, processing proceeds to step 806 in which microprocessor 601 calculates a new ID code according to a pre-stored algorithm in memory 602, encrypts the new ID code and stores it in memory 602, replacing the previous ID code stored therein. At step 807, microprocessor 601 transmits a signal to electronic switch 608 which allows power to flow from power source 504 through solenoid 209, and causes bolt blocking plunger 210 to retract in the direction toward the solenoid 209 for a predetermined period of time such as 5 seconds. At this time, the operator may turn the key body 101 and unlock the bolt. The microprocessor 601 then resets before the key body 101 is withdrawn from the insert slot 205. After the bolt is re-locked, the bolt blocking plunger 210 moves back to its blocking position shown in FIG. 2 by spring bias action.

If the coin telephone is one equipped with a smart terminal, processing proceeds from step 805 to step 808. In this step, microprocessor 601 determines whether the key serial number matches the serial number transmitted from the host computer, or whether the host computer has sent a message to prevent all keys from operating. If the key data matches the data stored in the memory 602, processing proceeds to step 806 as described above. If the key data does not match, or microprocessor 601 has received a prohibit message, processing proceeds to step 809.

As an additional feature, each lock may write its serial number and current time into a specific location of the memory 502 of the key in the event that all key data is valid to indicate that the specific lock was operated at the particular time stored with the serial number. Upon return of the key to the central office, the key may be re-inserted into the programmer interface unit 302 and the files in memory 502 read by the host computer in order to maintain a list of the locks that were operated as well as those that were not operated. All of the algorithms utilized by each of the lock microprocessors 601 are stored in the host computer 301 such that after the key is returned at the end of a collection cycle, the key may be reprogrammed with the new ID codes currently being stored in each of the operated locks, while the ID codes for the locks that have not been operated are left unchanged within the key memory 502.

Description will now be made of a second construction with reference to FIGS. 9–12. FIG. 9 illustrates a programmer 301*a*, which may be similar to the microcomputer programmer 301 of FIG. 3. The programmer 301*a* includes a CPU 901, a pair of look-up tables 902 and 903, and a daykey encrypter 904. Look-up table 902 contains a listing of various IDNs (identification numbers) and IDKs (encryption key codes) for each lock of the system. Every lock is identified by a lock identification number or IDN, and has associated therewith a corresponding encryption key code IDK which is used by the lock to encrypt data.

Look-up table 903 contains a listing of various IDNs and IDKs for each key unit 104*a* of the system. Each key unit 104*a* is also identified by a key IDN and has associated therewith a corresponding encryption key code IDK which is used by the key unit to encrypt data.

Daykey encrypter 904 contains an arbitrary encryption key code which is changed daily in the programmer 301*a* (thus the designation "daykey").

Key unit 104*a* includes a key module 906, a handheld computer 908, and optionally a modem 910. The module 906 interfaces the handheld computer 908 to the key device 101. Handheld computer 908 is a commercially available device such as a Panasonic Model JT-770, and may be implemented by any other equivalent apparatus. The computer 908 includes a key memory 502 which stores route stop information programmed from the programmer 301*a*. The route stop information is organized into a route table containing specific routes labeled by date. The key interface module 906 includes the IDN and IDK for the key unit 104*a*.

In operation, route stops for each collector are compiled by the programmer 301*a*. These route stops may be selected by a management operator, or may be downloaded into the programmer 301*a* from a central host management system. For each key unit 104*a*, which is identified by a particular key module IDN and corresponding encryption key code IDK, the programmer 301*a* compiles a set of locks which are to be serviced for collection (or other operations) by reading out a number of IDNs and associated IDKs of the locks to be accessed by the particular key unit 104*a*, from the look-up table 902, to thereby generate a route table for transmission to the key unit 104*a*.

The IDNs and IDKs of the various locks are encrypted by the encrypter 904 using the particular daykey encryption key code in use on that day. The daykey encryption key code is then itself encrypted using the IDK encryption key code of the specific key unit 104*a* for which the route table is being compiled. The encrypted daykey, denoted as DAYKEY (IDK), is then also transmitted to the computer 908 of key unit 104*a*.

In the key unit 104*a*, the IDN identification number and IDK encryption key code are stored in the key interface module 906, while the encrypted daykey DAYKEY(IDK) and the encrypted route tables are stored in the key memory 502 of handheld computer 908.

Referring now to FIG. 11, the lock memory 602 according to the second construction contains the IDN or lock identification number of that particular lock, the IDK encryption code associated with that particular lock, and an arbitrary seed number. The seed number is simply a certain numerical value, the actual value of which is not relevant.

In order for the encrypted IDNs and IDKs of the route tables stored in memory 502 to be decrypted, the handheld computer 908 sends the encrypted daykey to the key interface module 906, which decrypts the DAYKEY(IDK) using its encryption key code IDK to obtain the decrypted daykey. The encrypted IDNs and IDKs are then sent to the module 906 to be decrypted using the daykey, and used by the module 906 in the verification process with the lock.

This feature is intended as an additional security measure to achieve an even higher level of security, for the reason that the module 906 is an add-on feature to the computer 908 and is removable therefrom. Thus, in the event that the module is lost or stolen, neither the module nor the handheld computer can be used for access to any information with respect to lock ID codes or encryption key codes. Further, since the daykey encryption code is periodically changed in the programmer, the particular daykey stored in the module 906 is of limited use.

Operation of the second construction will now be described with reference to the flow chart diagrams of FIGS. 10, 10A, and 12.

Upon insertion of the key 101 into the keyway of the lock at step 1001, power is applied to the lock at step 1201. At step 1202, the lock sends a handshake protocol to the key, which receives the handshake at step 1002 and sends an acknowledge to the lock at step 1003. At step 1203, the lock recognizes the acknowledge and sends its IDN to the key at step 1204. The key receives the lock IDN and acknowledges at steps 1004 and 1005, and checks to see whether the lock's IDN exists in memory for the presently valid route table at step 1006. As previously mentioned, the route tables are labeled by date, and the computer 908 includes a clock for keeping track of the current date.

At step 1007, if the IDN is found, the key checks to see if the lock's corresponding IDK is found in memory for the particular IDN sent by the lock and acknowledges the lock if both IDN and IDK have been found, at step 1008. Upon receiving the acknowledge at step 1205, the lock sends the seed number from memory 602 to the key at step 1206. The key acknowledges receipt of the seed number at step 1010, and the lock then encrypts the seed number with its IDK at step 1208 upon receiving the acknowledge at step 1207.

The key also encrypts the seed number from the lock at step 1011, using the IDK found for the IDN received from the lock. At step 1012, the key sends the encrypted seed number to the lock, which receives it at step 1209. The lock then compares the encrypted seed number received from the key with the encrypted seed number which the lock itself generated, at step 1210. If the numbers match, the key is determined to be authorized to access the lock. At step 1211, the key writes the encrypted seed number into the memory 602 over the old seed number. The encrypted seed number will be used as the new seed number for the next access request from a key. At step 1212, the lock sends an acknowledge to the key to inform it of a successful access request, and activates the solenoid at step 1213. The lock then resets at step 1214. If any of the acknowledges from the key are not received within a predetermined amount of time, the lock routine also advances immediately to step 1214 for reset.

Upon receiving the acknowledge from the lock at step 1013, the key unit writes the date of access into the route table at step 1014, over the IDK previously stored there. As such, the key unit will thereafter not be able to access the lock without being reprogrammed by the programmer 301*a*. Such can be accomplished either by bringing the key unit 104*a* back to the management center, or by calling into the programmer via modem 910 for reprogramming in the field.

The key unit then proceeds to step 1015 where it is reset for the next lock access attempt.

In an alternative mode of operation, the key unit may be programmed to have a set number of accesses to each lock before requiring reprogramming. Such is shown in FIG. 10A, wherein a counter is incremented at step 1014*a*, and the value stored in the counter is compared with a preset maximum number of accesses at step 1014*b*. If this number has been reached, the lock IDK is replaced by the date of access and the key unit is reset at steps 1014*c* and 1015; otherwise the key unit is immediately reset at step 1014*d*. In either event, additional access to the lock may be denied upon an attempted access to another lock.

The devices shown in FIGS. 13–14 are directed to electronic locks that require a mechanical key and a handheld computer device that electronically enables the lock to be opened, such as using the electronic systems discussed in the preceding section. Thus, entry into the lock is only allowed when the user has a properly bitted mechanical key and a properly programmed handheld computer device, e.g., which contains the locks unique electronic identification number.

In these embodiments, the electronic lock is installed in the vault door of a parking meter. Most preferably, all of the electronic components of the electronic lock are included in the vault door. In this manner, existing parking meters can be upgraded to electronic lock systems by attaching a new or modified vault door.

The mechanical lock portion of the product includes a plug having tumbler pins which operate in a known manner to allow the plug to rotate when a properly bitted key is inserted into a keyway within the plug. Preferably, the tumbler pins are of the rotational tumbler pin type, such that the tumbler pins must be raised to an appropriate position as well as rotated to an appropriate position.

The face of the plug includes a contact that is connected to a small wire that travels through the plug beside the keyway. Upon insertion of the electronic key means into the keyway, the keyblade can form an electrical ground to the plug while the key means provides an electrical path between the electric lock and the hand held computer, such as described in the preceding section.

Most preferably, the lock is designed with a keyway configured to receive a keyblade that is 1/8th inch thick, or more. Preferably, the keyway is generally parallel to the horizonal in a locked position, and is generally vertical in an unlocked position. Because users often utilize the key as a vault door "handle" when opening the meter, a 1/8th inch thick key is preferred and it is preferred to orient the key with its major axis in the vertical direction when opening the meter. This provides greater strength and life than other existing arrangements. Increased strength and life can be very important with parking meters because the number of daily collections from such meters can be very high, and the vault doors are typically heavy metal doors, e.g., such as 3 lbs or more.

The electronic lock in the most preferred embodiments is fully integrated into existing parking meter vault doors. Each electronic lock can be, thus, self contained and can require no electrical connection to other parts of the parking meter. Preferably, existing brackets, etc., for mounting the vault door of the parking meter remain in use, such that the parking meters are readily adapted to electronic capabilities.

A first embodiment is shown in FIGS. 13(A)–13(G). In this embodiment, a common round vault door 2000 is upgraded to include electrical capabilities. In order to upgrade an existing vault door 2000, a larger central bore 2010 is formed into the door 2000 to accept a wider plug 2020. As shown in FIG. 13(A), the plug 2020 preferably includes a horizontal keyway 2021—when locked—and an electrical contact 2022.

A mounting bracket 2030 is used to attach the vault door 2000, to a parking meter. Preferably, the mounting bracket 2030 is an existing bracket that is modified as discussed below to accommodate the device. As shown, the bracket 2030 includes a pivoting member 2031 having two arms and a support member 2032 attached to the vault door and pivotally supporting the member 2031. The bracket 2030 attaches to the parking meter body B in a known manner.

As shown in FIG. 13(C), the member 2032 includes raised sections 2033, 2033' creating slots thereunder for receiving dead bolts 2040, 2040', respectively. Inner ends of the dead bolts 2040, 2040' include pins 2041, 2041' extending perpendicular to the broad flat sides of the dead bolts (as shown in FIG. 13(B), the dead bolts preferably have a generally flat rectangular cross-section). The pins 2041, 2041' are received with a cam member 2050 having receiving slots 2051, 2051' which receive the pins 2041, 2041'. A rearwardly extending plug element 2052 is received in a similarly shaped central opening 2053 of the cam member. The plug element 2052 is preferably configured to snugly fit within the opening 2053 to rotate the cam member 2050 when the plug is rotated via the mechanical keyblade. Preferably, the opening 2053 is constructed to have a general circular shape with at least one inwardly extending tab member 2054. Preferably, two tab members 2054 are provided, as shown. The element 2052 is configured to receive the tab member(s). These tab members preferably are constructed to be more easily sheared by rotational forces than a pin 2061 of a solenoid 2060 (as discussed below). In this manner, if a user attempts to over stress the mechanical key to force the lock to open without having an appropriate electronic communication, the tab member(s) 2054 will shear and the plug 2020 and element 2052 will be caused to freely rotate within the bore 2010 without moving the cam member 2050.

As shown in FIG. 13(C), the support member 2032 includes a generally rectangular plate 2034 having four openings 2035 for receiving bolts for attaching the plate 2034 to the door 2000. Preferably, special bolts are used that require a special tool to be rotated in order to inhibit tampering, e.g., such as bolts 3036 shown in FIG. 14(E) or the like. The member 2032 also includes side walls 2036 which pivotally support the member 2031.

In the illustrated embodiment, the plate 2034 is also adapted to have a central opening (not shown) for receiving the element 2052 and an opening to receive the solenoid pin 2061. As shown in FIG. 13(G), the door 2000 is preferably modified to have an enlarged central bore 2010. In addition, preferably, a bore 2001 is drilled into the door 2000 to accommodate the solenoid 2060 under the plate 2034 with its pin 2061 extending along an axis generally perpendicular to a plane of the plate 2034. In this manner, the solenoid 2060 is secured between the plate 2034 and is protected—at least in part—by the heavy material of the vault door 2000. As should be understood, the bore 2001 should only be drilled partially into the width of the door. Most preferably, a highly drill resistant material, such as certain steels, is located at the bottom of the bore 2001 to prevent an individual from drilling into the solenoid through the door 2000.

Similarly, the electronics of the lock are preferably provided within a bore, or pocket, 2002 that is machined into the door 2000 at a location behind the plate 2034. As shown in FIG. 13(G), the door 2000 includes threaded receiving holes 2003 for receiving bolts that are passed through the holes 2035 in the plate 2034.

In operation, when the lock is in a locked condition, the cam member 2050 is located in a position with the pin 2061 extending up into a notch 2055 cut out of the peripheral side edge of the cam member 2050. In this manner, the cam member 2050 is not capable of being rotated until the pin 2061 is retracted into the solenoid 2060. When the pin 2061 is retracted and the element 2052 is rotated clockwise, the cam member 2050 is rotated clockwise therewith. As a result, the pins 2040, 2040' move towards the center axis of the plug 2020 due to the configuration of the receiving cam slots 2051, 2051' to unlock the lock. In the position of the cam member 2050 shown in FIG. 13(C), the cam member 2050 is located between a locked position and an opened position. As shown, the pin 2061 is preferably retracted to a position below the cam member 2050 when the pin is released from the notch 2055. The cam member is preferably rotated through an angle of about 90 degrees between the locked and opened positions, such that the keyway is approximately horizontal when locked and vertical when unlocked.

The dead bolts 2040, 2040' operate to lock and unlock the door 2000 to a parking meter body B (shown in dashed lines in FIG. 13(A)) in a known manner. The parking meter body B can be of a variety of forms and is typically mounted on a pole P extending therebelow. The illustration shown in FIG. 13(A) shows the door 2000 arranged in normal vertical orientation.

Some individuals can possibly perform a sophisticated theft by striking the parking meter body B in a direction along the axis of the pin 2061 so that the pin moves into the solenoid by rapid acceleration of the solenoid. For example, an individual may attempt to strike the parking meter with a hammer or the like to cause the pin 2061 to retract at the same time the plug 2020 is caused to rotate by a key or otherwise. To prevent this possibility, a re-locking device 2070 (see FIGS., 13(C) and 13(D)) is preferably provided. The re-locking device includes a cylindrical head 2071, a shaft 2073 that extends through a hole in the plate 2034, a spring 2072 that biases the head upwards away from the surface of the plate 2034, and a base 2074 at the opposite side of the plate 2034. When in a locked position, the cam member is located such that a tang 2056 on the peripheral side edge thereof is positioned to the left of the re-locking device, see dotted line illustration of the tang portion in a locked position in FIG. 13(C). The head 2071 is normally spaced a sufficient distance above the top surface of the cam member 2050 such that the tang 2056 will normally move freely underneath the head 2070, see dotted lines in FIG. 13(D).

When the parking meter body B is subjected to rapid acceleration, e.g., via a hammer strike, the re-locking device functions to also move to a position in front of the tang 2056 for the duration of time that the pin 2061 is retracted. Accordingly, the re-locking device 2070 operates to re-lock the cam member 2050 under these circumstances. The location, weight, spring force, etc., of the re-locking device can be selected to ensure a proper operation of the device.

Preferably, a cover plate 2080, FIG. 13(F), is mounted over the plate 2034 at the lower holes 2035 so as to cover a portion thereof as shown in dashed lines in FIG. 13(C). The cover plate is, thus, fixable over the cam member 2050 and, among other things, covers the solenoid pin 2061. The cover plate 2080 also includes a portion 2081 for covering the element 2052. As shown in FIG. 13(C), the cover plate can also be used to protect wiring W from the contact 2022 (showing FIG. 13(A)) that extends through element 2052 toward the electronics within the electric lock. As shown, the cover plate 2080 can include an opening 2082 for receiving the head 2071 to avoid obstructing the operation of the re-locking device 2070. It should also be understood that the plate 2080 would be spaced at least slightly above the cam member 2050 to also avoid obstructing the operation of the cam member 2050. As shown, the member 2031 can be made to have a central opening 2031' to receive the portion 2081 because the portion 2081 is preferably raised a sufficient height that could otherwise interfere with the operation of the member 2031.

With the above device, a method of upgrading an existing lock can include, for example, modifying an existing door and existing bracket to be constructed as discussed above, including a cam member 2050, a solenoid 2060, electronics within bore 2002, etc., to provide electronic capabilities of the lock.

In one alternative arrangement, the device is adapted to have the solenoid 2060 located with its pin extending in a vertical axis. The parking meter body B is typically mounted on a vertical pole. Thus, when the solenoid is oriented vertically, the solenoid pin 2061 could not be moved by striking the body B with a hammer. As a result, the re-locking device 2070 is not necessary. In order to modify the device to operate with a vertically oriented solenoid, rather than with a generally horizontal solenoid as shown, as some exemplary constructions a) the solenoid pin 2061 could be an L-shaped pin that extends upwards (through the plate 2034) into a notch similar to the notch 2054 (configured to release and receive the L-shaped pin) within the cam member 2050 and to retract away from the perimeter edge of the cam member, b) the cam member can include a perpendicular wall that extends laterally from the cam member 2050 (e.g., down through a hole in the plate 2034) and that has a notch arranged to receive a vertically oriented solenoid pin.

FIGS. 13(H) and 13(I) illustrate another round parking meter door 2000' having a slightly modified bracket structure 2030'. The device can be adapted to the form an electronic parking meter as well as other known parking meters.

A second embodiment is shown in FIGS. 14(A)–14(H). In this embodiment, a common rectangular vault door 3000 is upgraded to include electrical capabilities. In order to upgrade an existing vault door 3000, a larger central bore 3010 is formed into the door 3000 to accept a wider plug 3020. As shown in FIG. 14(A), the plug 3020 preferably includes a horizontal keyway 3021 (when locked) and an electrical contact 3022.

A mounting tab 3030 extends from one end of the vault door 3000 and, in conjunction with the locking bolt 3040 can be used to lock the door 3000 to a parking meter in a known manner.

As best shown in FIG. 14(E), the door 3000 includes a locking bolt support 3100. The support 3100 includes a slot 3101 for receiving the locking bolt 3040. In addition, the support is preferably modified to have an increased diameter bore 3010 for receiving a mechanical plug 3020. The mechanical plug 3020 is preferably similar to the plug 2020 discussed above in the first embodiment.

In addition, the support is preferably modified to have a bore 3001 for receiving a solenoid 2060 having a solenoid pin 2061. The bore 3001 thus provides a protected area for the solenoid. As in the first embodiment, an anti-drill material can be located within the bore 3001 to protect the solenoid from being drilled into.

The locking bolt 3040 preferably has a first through hole 3051 which receives a drive pin 3041 that is attached to the rear of the plug 3020, whereby rotation of the plug causes the drive pin to follow a circular path that is used to reciprocate the locking bolt 3040 within the slot 3101. The locking bolt preferably also has a second through hole 3061 added therein for receiving the pin 2061 of the solenoid. Wiring W from the rear of the plug 3020 and the solenoid 2060 can be directed beneath the bolt 3040, and, if desired, through a channel bored into the support member to facilitate passage of such wiring thereunder.

A first plate member 3034, FIG. 14(G), has electronic circuitry 3002 mounted to a bottom surface thereof and mounting holes 3035 for attachment into threaded holes 3003 in the door 3000. That is, the plate 3034 is connected by being flipped over from the orientation shown in FIG. 14(G), placed such that the holes 3035 align with the holes 3003, and then bolts 3036 are inserted to attach the plate to the door with the electronics 3002 underneath and protected by the plate 3034. As shown, the plate preferably includes a solenoid cover portion 3037 that extends over the solenoid 2060 within the bore 3001 to maintain, cover and protect the solenoid. A hole 3038 in the portion 3037 allows the pin 2061 to extend therethrough to be received in the hole 3061 in the locking bolt. As shown in FIG. 14(E), the door 3000 has an interior cavity area 3004. The plate 3034 preferably includes depending side portions 3034-1, 3034-2 and 3034-3 that extend down toward the bottom of the cavity area 3004 to provide a protected enclosure thereunder. The plate 3034 is thus located as shown in dashed lines in FIG. 14(D). The plate 3034 is preferably located below the bolt 3040 and the portion 3037 preferably rests on the bottom surface 3102 of the slot 3101.

In order to cover the solenoid pin 2061 and other parts of the lock, a second plate 3031, FIG. 14(C), is preferably attached over the top of the first plate 3034 and the support 3100. The second plate 3031 preferably includes a first generally rectangular portion 3032 that extends over the top of the support 3100, a narrow portion 3033 that fits between the adjacent sides of the support 3100 and covers the pin 2061 and a second rectangular portion 3039 that fits over the portion of the locking bolt 3040 that extends out of the support 3100. FIG. 14(C) shows a top surface of the plate 3031. The plate 3031 is mounted on the door in FIG. 14(D) in the same orientation as shown in FIG. 14(C). The portion 3039 preferably has downwardly extending sides, see FIG. 14(B), that surround the bolt 3040 and extend down to the plate 3034. The plate 3031 is preferably attached to the plate 3034 by the inclusion of receiving holes 3035' in the plate 3034 and tabs T in the plate 3031 extending from a bottom of the downward sides. The tabs T are placed in the holes 3035' and then the plate 3031 is lowered against the support 3100 with the threaded holes 3003' in alignment with the holes 3035" in the plate 3031. The plate 3031 is then secured to the threaded holes 3003 in the support member with bolts, such as bolts 3036 as shown in FIG. 14(E).

As shown in FIGS. 14(D), 14(E), and 14(H), the device also preferably includes a re-locking device 3070 similar to the re-locking device 2070 of the first embodiment. As shown, the re-locking device can be mounted inside a bore 3005 in the support 3100. The re-locking device preferably includes a head 3071, a shaft 3073, a base 3074, and a spring 3072 surrounding a lower shaft extension that normally biases the head above the bolt 3040. Upon striking the meter with a sufficient force to move the pin 2061, the head also moves to a locking position within a slot S formed in the locking bolt 3040 to prevent movement thereof. The shaft 3073 is positioned off to the side of the locking bolt 3040 to avoid obstructing the motion thereof. As shown in FIG. 14(C), the plate 3031 preferably includes an extension 3032' that covers the bore 3005 when mounted to the door 3000 to contain the re-locking device therein.

The drive pin 3041 is preferably constructed to be weaker than the solenoid pin 2061. In this manner, if a user attempts to apply force to rotate the plug, the pin 3041 will break initially so that the plug will thus merely rotate freely without moving the bolt 3040.

In operation, when the lock is in a locked condition, the pin 2061 extends up into the hole 3061. In this manner, the bolt 3040 is not capable of being moved until the pin 2061 is retracted into the solenoid 2060. When the pin 2061 is retracted and the plug element is rotated, the pin 3041 causes the bolt to reciprocate via a camming action within the hole 3051.

As with the first embodiment, the plug is preferably rotated through an angle of about 90 degrees between the locked and opened positions, such that the keyway is approximately horizontal when locked and vertical when unlocked. As with the first embodiment, the device can also be adapted to have the solenoid 2060 located with its pin extending in a vertical axis to reduce potential thefts and to avoid the need for a re-locking device. In order to modify the device to operate with a vertically oriented solenoid, rather than with a generally horizontal solenoid as shown, in one exemplary construction the solenoid pin 2061 could be attached to a lever which pivots out of a hole 3061 upon retraction of the pin 2061, etc.

As noted, there still remains a need for an improved anti-tampering device for electronic solenoids having spring-biased elements and the like, such as used in electronic locks for vending machines, telephones, parking meters and the like.

SUMMARY OF THE INVENTION

The present invention overcomes the above and other problems in existing devices having electronic solenoids with spring-biased elements and the like, such as used in electronic locks and the like.

According to a first aspect of the invention, an anti-tamper locking assembly for locking a position of a block is provided having: an electrical moving means, selectively activated by an electronic circuit, for moving a pin that is normally maintained in a first position in an un-energized state of said moving means to a second position in an energized state of said moving means, said pin having an overhanging portion that extends laterally from at least one side of said pin; a block mounted to move along a path passing transverse to an axis of said pin; said block having a pin blocker extending outward from a side of said block; said block having at least one spring-arm mounted thereto, said spring-arm being normally maintained in a first position near said axis of said pin and being moveable in a direction away from said axis of said pin; wherein in an un-energized state of said moving means a) when said block is moved along said path to an adjacent position whereat said pin is adjacent said pin blocker, said overhanging portion abuts said pin blocker and a surface of said spring-arm member is positioned to block said overhanging portion to prevent said pin from being forced to a position wherein the overhanging portion does not abut said pin blocker, and wherein in an energized state of said moving means a) said overhanging portion is moved to a position whereat when said block is moved along said path, said overhanging portion abuts said spring-arm to cause said spring-arm to move laterally away from the axis of said pin and b) said overhanging member is positioned so as to pass said pin blocker when said block is moved along said path past said adjacent position.

According to another aspect of the invention, the above anti-tamper locking assembly is provided within an electronic lock.

According to another aspect of the invention, said pin extends through a slot in said block, said moving means is on a first side of said block and said overhanging portion of said pin is a head portion located on a second side of said block opposite to said first side, and wherein when said moving means is energized, said head portion is drawn towards a surface of said block.

According to another aspect of the invention, said spring-arm includes at least one elongated rod located along a side of said slot and normally positioned so as to be locatable beneath said head portion of said pin.

According to another aspect of the invention, said block has a generally flat surface, said axis of said pin being generally perpendicular to said generally flat surface.

According to another aspect of the invention, said block is linearly reciprocatable in a first plane generally parallel to said flat surface.

According to another aspect of the invention, said moving means includes a solenoid.

According to another aspect of the invention, said moving means includes a shape memory alloy.

The above and other advantages, features and aspects of the present invention will be more readily perceived from the following description of the preferred embodiments thereof taken together with the accompanying drawings and claims.

BRIEF DESCRIPTION OF THE DRAWINGS

The present invention will become more fully understood from the detailed description given hereinbelow and the accompanying drawings which are given by way of illustration only, and are not limitative of the present invention, and wherein.

DETAILED DESCRIPTION OF THE PREFERRED EMBODIMENTS

FIGS. 15–17 illustrate preferred embodiments of anti-tamper mechanisms and locks incorporating these mechanisms according to the present invention.

The preferred embodiments can be used to prevent individuals from causing a solenoid pin or the like from being moved by way of force subjected to an enclosure for the solenoid. When a housing containing a solenoid pin or the like is subjected to rapid acceleration, e.g., via a hammer strike, the pin can be temporarily moved to an energized position due to the rapid acceleration of the housing.

The present invention can be incorporated into any locking mechanism having a pin that is retracted to allow movement of a block (a solid member). The most preferred applications for this invention are in electronic locks, such as for pay telephones, vending machines, parking meters, etc. The present invention can also be used as an anti-tampering device in applications other than locks, such as where a solenoid pin is retracted to allow access or to provide an alternate outcome of some nature—e.g., in cases where a pin fixes the location of a plate member until movement thereof is electronically permitted. The present invention can be used in any spring loaded electrical moving means (see discussion of "electrical moving means" below) that might be capable of being overcome by external forces. The language "spring-loaded" is used herein to refer to any means by which an element, such as a pin, is normally biased to one location and only moved therefrom upon application of force, such as, e.g., via a solenoid or electromagnet. This "spring-loading" may be done by way of any biasing means, including, as some examples, springs, magnets, gravity, etc. The language "pin" refers to a member that can be moved by an electrical moving means and that can support an overhanging member or head at some position thereon. Preferably, the pin is elongated and linear, but not necessarily.

Figure 1A:
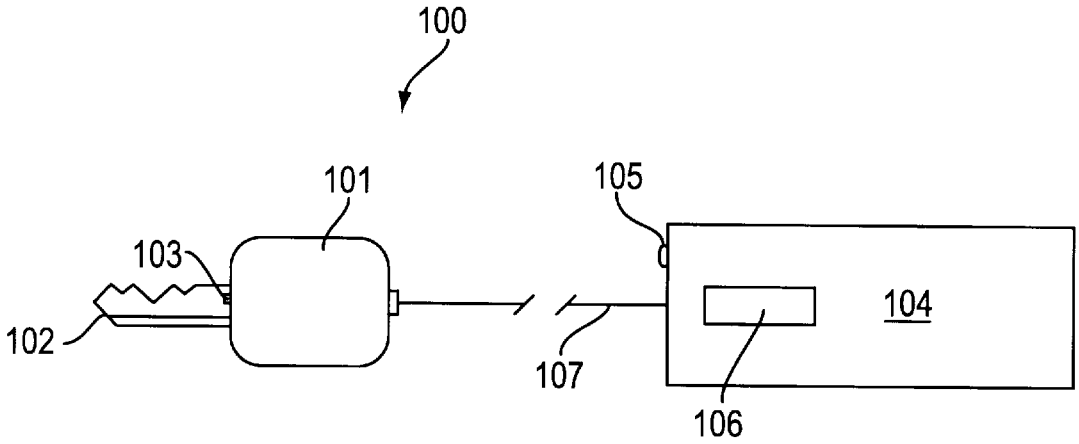
FIGS. 1A and 1B are side and end elevational views, respectively, of an electronic key with its own power supply.
Figure 1B:
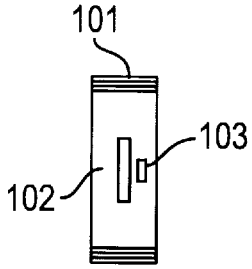
Figure 2:
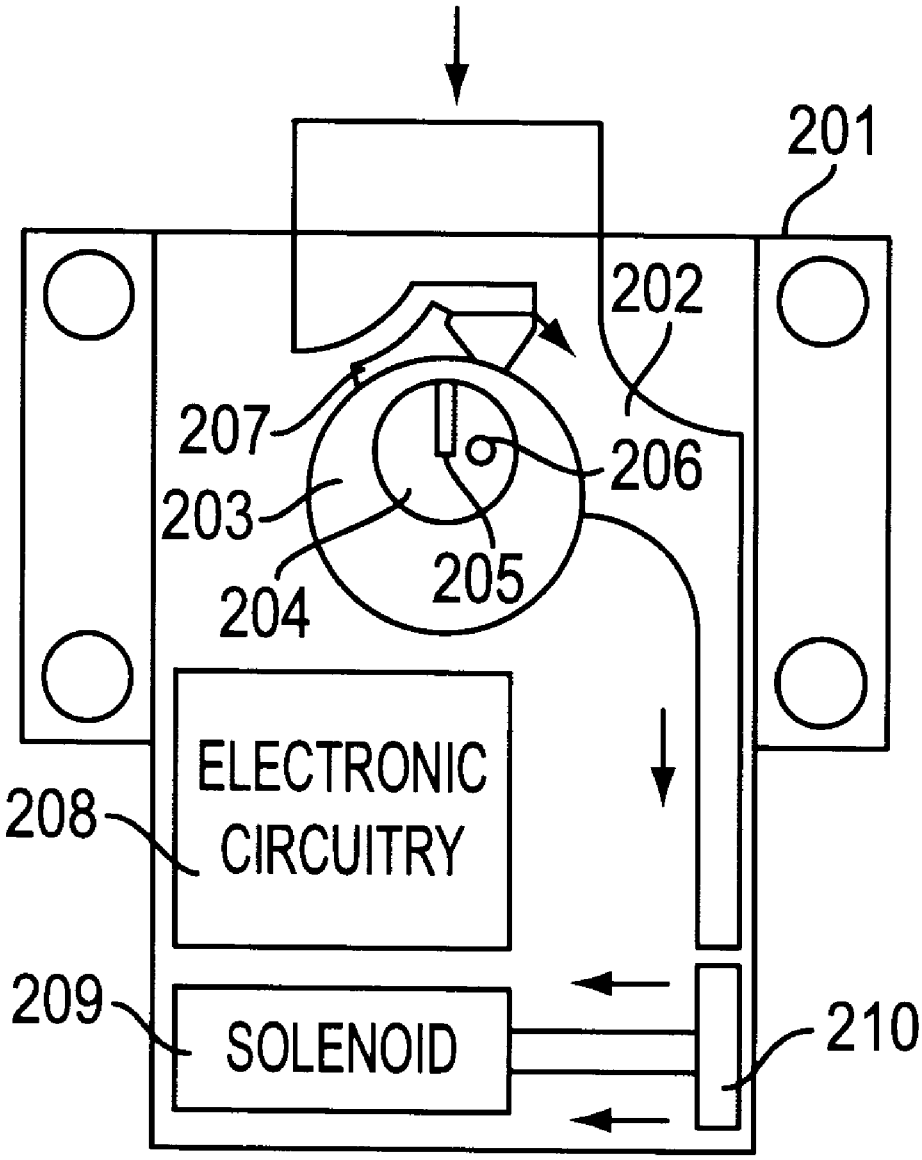
FIG. 2 is a front elevation view of a lock cylinder and associated mechanisms (shown with the housing cover removed) for operation with the key of FIGS. 1A and 1B.
Figure 3:
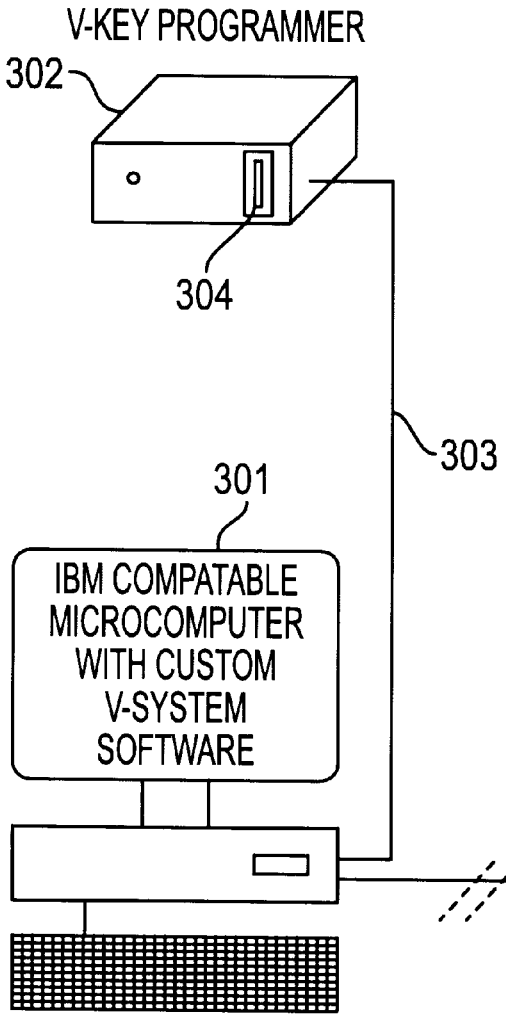
FIG. 3 is a schematic view of a first embodiment of an electronic key programmer.
Figure 15A:
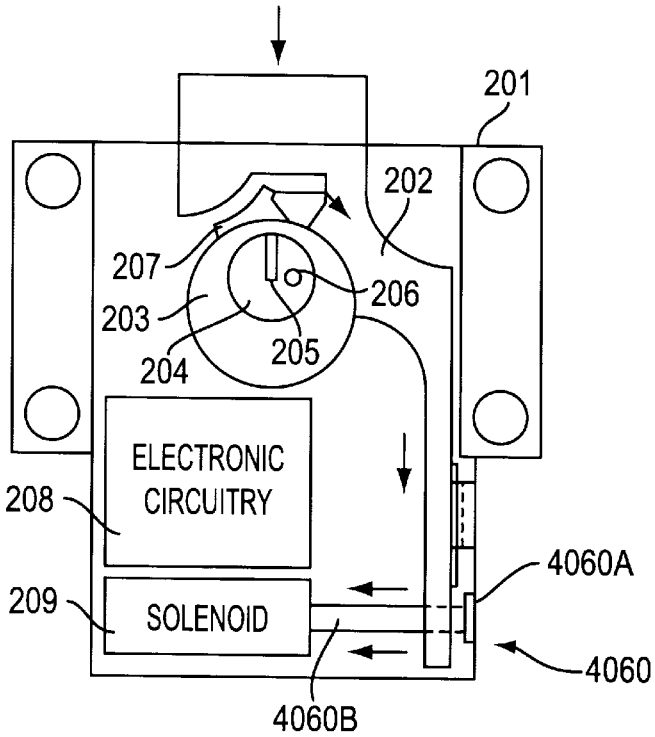
FIG. 15(A) is a front view similar to FIG. 2 showing a modified electronic lock having an anti-tamper device according to a first embodiment of the present invention.
Figure 15B:
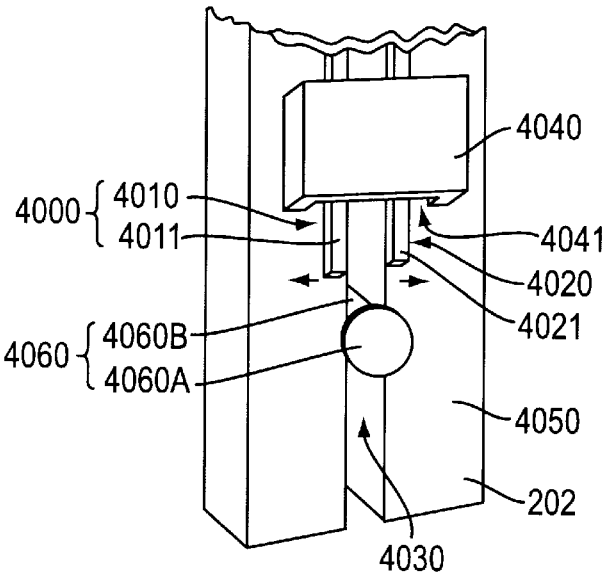
FIG. 15(B) is a perspective view of a portion of the locking bolt and anti-tamper device shown in FIG. 15(A)

FIGS. 15(A) and 15(B) illustrate a first embodiment of the invention in a device similar to that of FIG. 2. In certain conditions, the embodiment in FIG. 2 could be subject to tampering. The modification shown in FIGS. 15(A) and 15(B) eliminate this possibility. As discussed above, the bolt or block 202 moves along the path of the vertical arrows to unlock the device. The solenoid 209 retracts the solenoid pin 4060 in the direction of the horizontal arrows in order to allow the bolt or block 202 to move downward to open the lock.

Figure 15C:
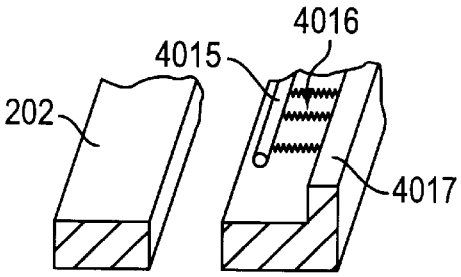
FIG. 15(C) is a perspective view of an alternative embodiment of the locking bolt and anti-tamper device shown in FIGS. 15(A) and 15(B)

As shown in FIG. 15(A), a modified solenoid pin 4060 includes an enlarged head portion 4060A and a narrow rod portion 4060B. In an non-energized state, the head portion is spaced away from the surface 4050 of the bolt 202. Preferably, two resilient spring-arms 4010 and 4020 extend along the sides of a slot 4030 formed in the bolt 202. The spring-arms can be fixed to the bolt 202 in a variety of ways. For example, an upper end of the spring-arms (not shown) can be fixed to the bolt 202. In the embodiment shown in FIG. 15(B), the spring-arms have a generally flat top surface 4011 and 4021 and a generally rectangular cross-section. The arms can also have a circular cross-section, e.g. FIG. 15(C), or another cross-sectional shape. Although the preferred spring-arms include elongated members or rods, the spring-arms can be formed to have other configurations, such as e.g. large flat sheet-like members, as long as the arms extend along a sufficient portion of the slot and can be moved by the head 4060A. In a preferred embodiment, the spring-arms themselves impart a spring force, e.g., being made of a metal or other material having a sufficient elasticity. In this regard, the spring arms can, for example, be fixed at their upper ends (not shown) to the bolt 202 and can be flexed outwardly by force and returned inwardly by their elasticity. Other forms of biasing can be used, as long as the arms are, in an unbiased state, positioned close enough to the slot to block the head portion 4060A from contacting the surface 4050. For example, as shown in FIG. 15(C), the spring-arms can include a rod 4015 attached via resilient means 4016 along at least a portion of the length thereof to a member 4017 fixed to the bolt 202. Although two spring-arms are preferred, the device can also contain only one spring arm along one side of the slot 4030, e.g. FIG. 15(C).

The head portion 4060A preferably has a diameter that is wider than the slot 4030, with the rod portion 4060B narrower than the slot 4030. The slot 4030 preferably extends to the end of the bolt to insert the pin 4060 into the slot.

Upon electronic authorization, the solenoid draws the head 4060A against the surface 4050 of the bolt 202. (As discussed below, in other alternatives, the solenoid can be replaced with other electric moving means that can be used to similarly move a pin.) With the head held against the surface 4050, if the bolt 202 is moved, e.g., via a key, the bolt 202 and solenoid blocker 4040 extending from the bolt 202 (the blocker can either be attached or integrally formed therewith) move respective to the solenoid pin 4060. The foremost ends of the arms 4010 and 4020 contact the head 4060A and resiliently spread around the head, which has a diameter larger than the distance between the spring-arms. In order to facilitate insertion, the head is preferably generally circular as shown. Alternatively, the head and/or spring-arms can include tapered or otherwise modified contact edges to facilitate lateral insertion of the head to push the spring-arms. If the head 4060A is held against the surface 4050 while continually forcing the spring-arms apart, the head 4060A can enter a channel 4041 in the solenoid blocker 4040. The channel 4041 can receive the solenoid head 4060A therein only when the head is substantially against the surface 4050, i.e., in the energized state of the solenoid and with the spring-arms separated. When the bolt 202 reaches a final position, where a vault door can be opened, the head 4060A is preferably located beneath the solenoid blocker 4040 so that the solenoid blocker holds the head sufficiently against or near the surface 4050 to keep the spring-arms apart. The spring-arms preferably extend into the channel 4041, although is not necessarily required. And, the channel 4041 preferably extends completely across the blocker 4040 with the spring arms extending therethrough as shown. In this manner, the blocker also helps to protect the spring-arms.

If an individual tries to break-into the lock, without moving the head 4060A against (i.e., at or sufficiently near) the surface 4050, the solenoid blocker 4040 will abut the head 4060A and prevent the bolt 202 from moving.

When an individual strikes the housing with a hammer, due to the short period of contact between the head 4060A and the surface 4050, the bolt 202 cannot be moved—e.g., via a key—at a speed required to engage the spring arms and move the head portion 4060A into the channel 4041 beneath the blocker 4040. The length of the spring arms and head size can be selected to ensure that the time of contact between the head 4060A and the surface 4050 is insufficient for the head portion 4060A to move into the channel 4041 beneath the blocker 4040. Upon impact, the head portion will "rebound" off the surface 4050, and the spring-arms will, thus, remain beneath the head 4060A. When the spring-arms are beneath the head 4060A, the head 4060A does not have the required clearance to enter the channel 4041 and the head 4060A cannot be forced against the surface 4050. As a result, the bolt 202 must be returned to a position where the head portion is no longer above the spring-arms. Thus, an attacker will have to return the bolt 202 to the initial position, and any repeated efforts will continue to be unsuccessful.

Figure 16A:
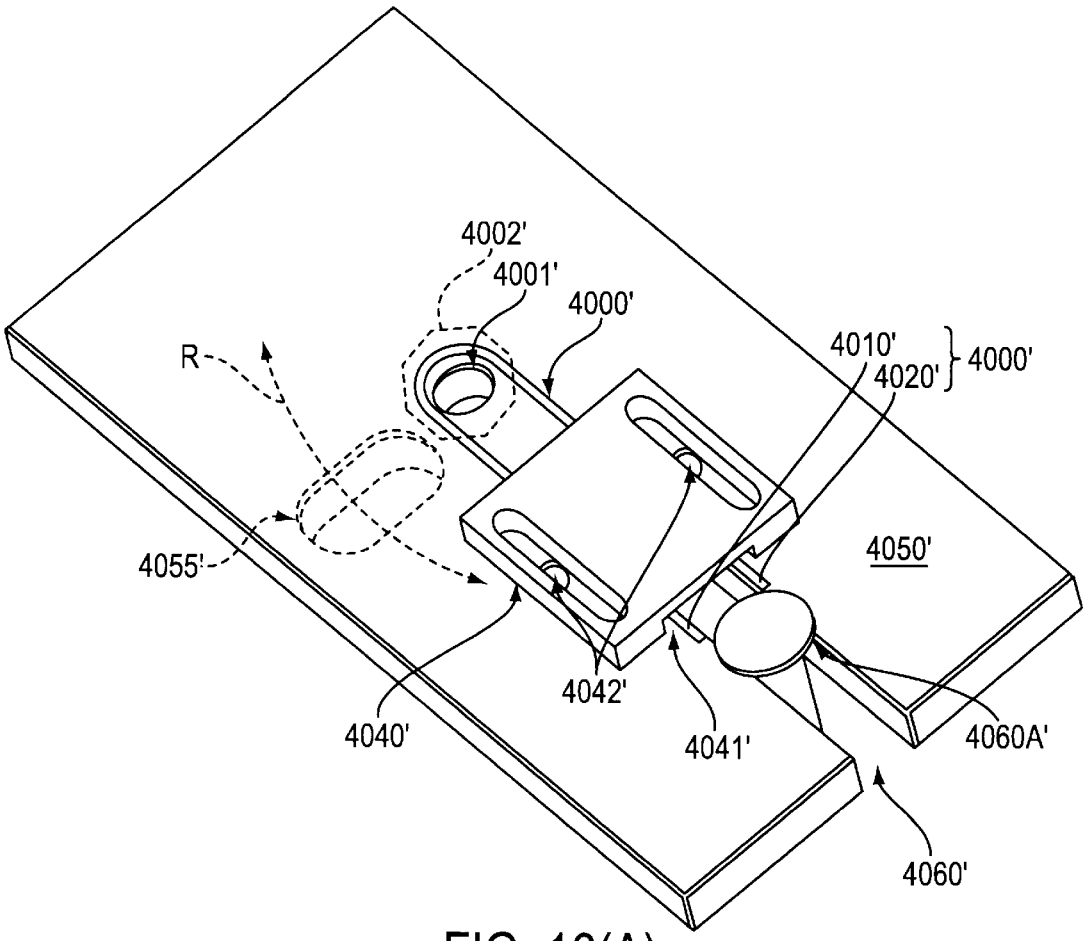
FIG. 16(A) is a perspective view of an anti-tamper device according to another embodiment of the invention.
Figure 16B:
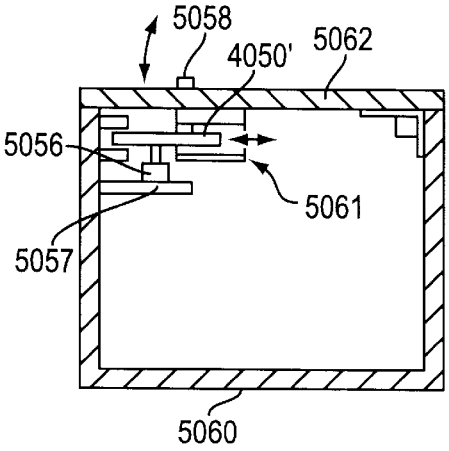
FIG. 16(B) is a schematic plan view of an electronically locked enclosure showing an anti-tamper device placed therein according to one embodiment.

FIG. 16(A) shows a second embodiment similar to that shown in FIGS. 15(A)–15(C). This second embodiment also operates to prevent a block 4050' from moving relative to a solenoid pin 4060' unless the head 4060A' is maintained against (e.g., contacting or near) the block 4050'. In one exemplary application of the second embodiment, the block 4050' is a locking bolt that is laterally moved to allow access to an enclosure. For example, as generally shown in FIG. 16(B), the locking bolt 4050' can be mounted in an enclosure 5060 within a guide 5061 on a door 5062 so as to be laterally movable via means 5058 (e.g., any known means accessible outside the enclosure). A solenoid 5056 is mounted to a support 5057 fixed to the enclosure 5060 in such a manner that when the means 5058 is operated at the same time that the solenoid is electrically energized, the bolt 4050' can be moved to allow entry into the device. The means 5058 can be any known means for imparting lateral movement to the bolt 4050'—such rotated members, e.g., knobs, handles, plugs with keyways (as in other embodiments herein), and laterally moved members such as a handle or shaft that is laterally moved to impart lateral movement to the bolt 4050'. Although the more preferred embodiments use an electronic locking mechanism in conjunction with a mechanical locking mechanism using an electronic key means, the present invention can be applied in cases where no mechanical lock is included—that is, where the electrically moved pin provides the only locking structure. In this situation, the present anti-tamper device provides a very safe structure and allows sizes of the locking structure to be readily reduced or miniaturized while maintaining safe locked conditions.

Figure 14A:
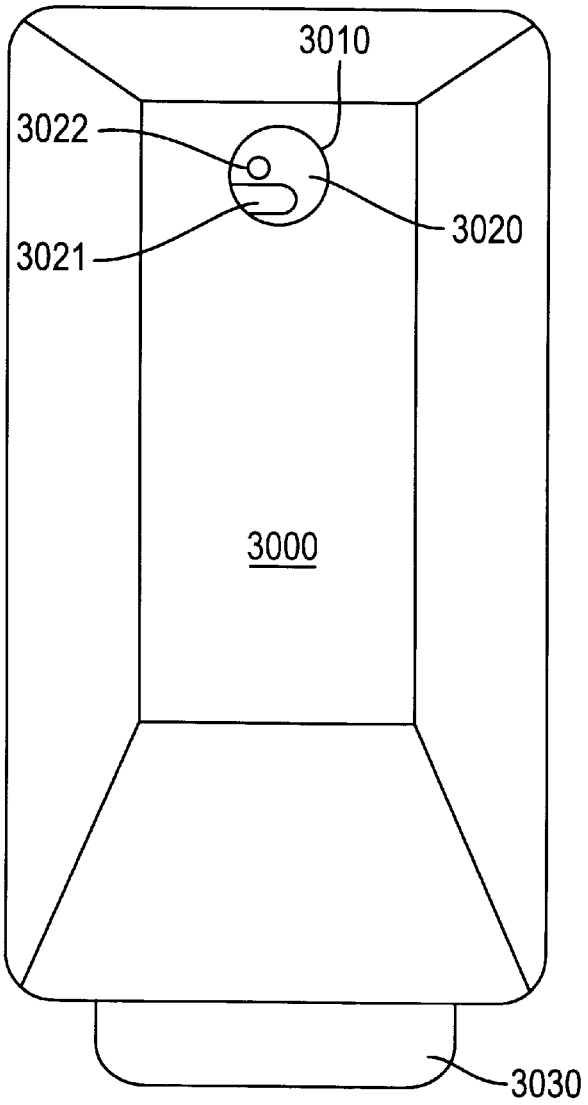
FIG. 14(A) is a front view of a vault door on a parking meter according to a second embodiment.
Figure 14B:
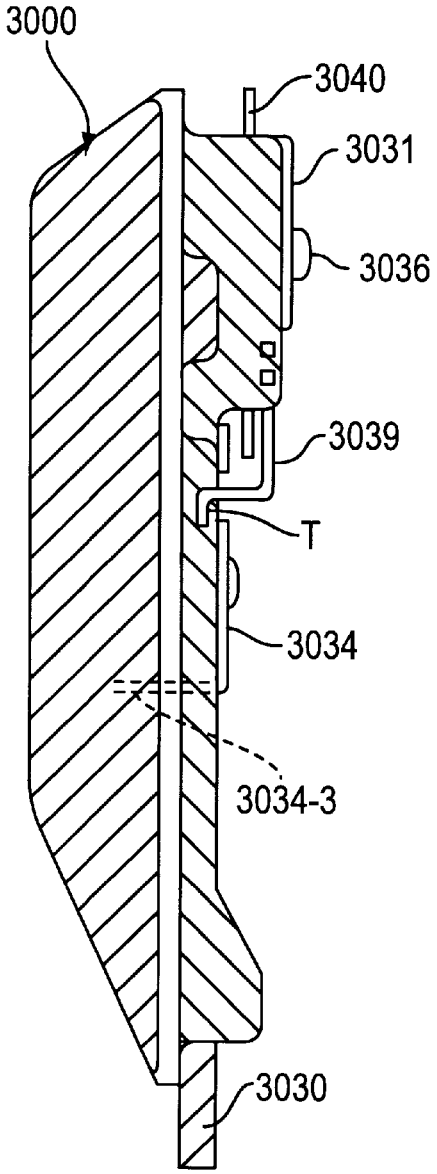
FIG. 14(B) is a side view of the vault door from the right side in FIG. 14(A)
Figure 14C:
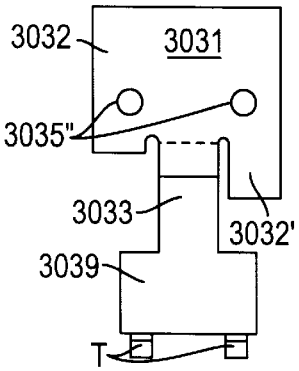
FIG. 14(C) is a top view of a preferred top plate of the second embodiment.
Figure 14E:
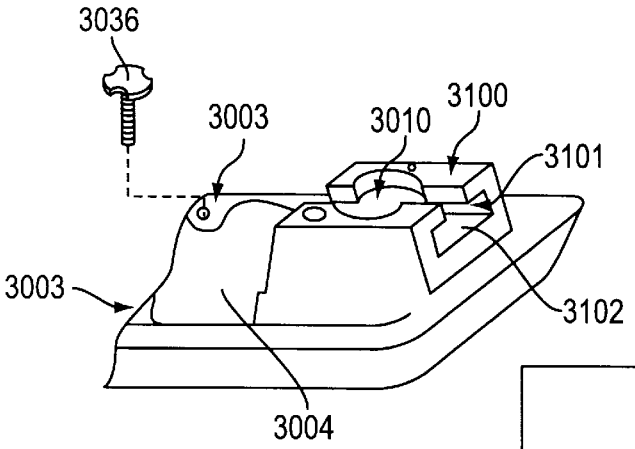
FIG. 14(E) is a perspective view showing a support portion 3100 in the rear of the vault door.
Figure 14F:
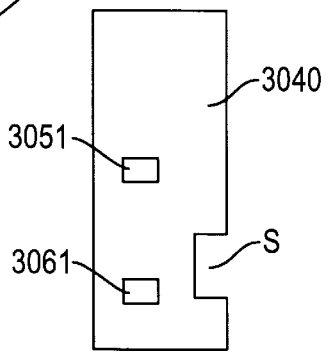
FIG. 14(F) is a top view of a locking bolt of the second embodiment.
Figure 14D:
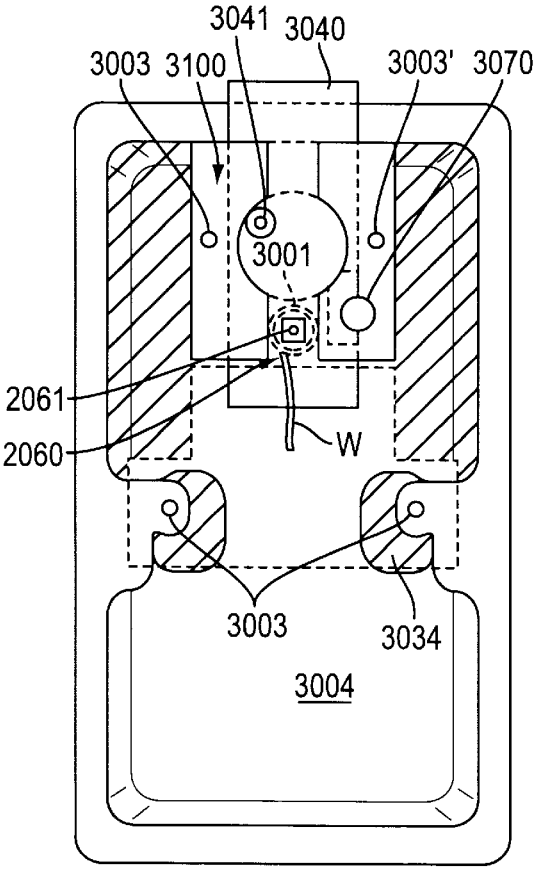
FIG. 14(D) is a rear view of the vault door showing the interior of the vault door and the mounting of the electronic components therein.
Figure 14G:
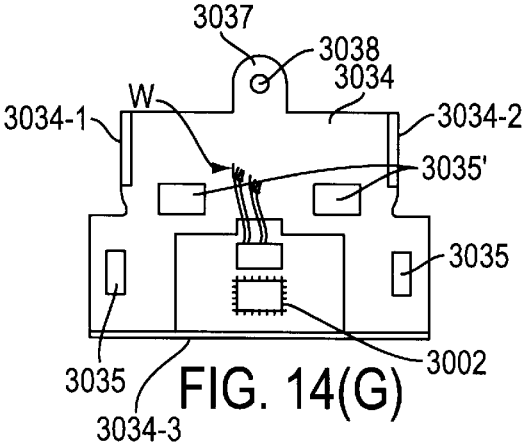
FIG. 14(G) is a bottom view of a preferred cover plate of the second embodiment.
Figure 14H:
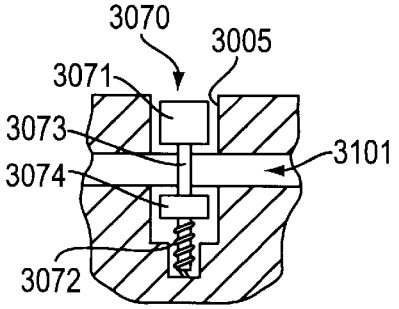
FIG. 14(H) is a cross-sectional view showing the preferred arrangement of the re-locking device within the support member of the vault door of the second embodiment.

In one preferred example, the structure in FIG. 16(A) can be included in the parking meter lock shown in FIG. 14(D). In that case, this structure would replace the bolt, the solenoid and the re-locking device, and a receiving hole 4055' can be formed to receive a cam member which follows the circular path R.

FIG. 16(A) also shows another modification of the spring-arms. As discussed, the spring-arms can be formed in variety of ways. In alternative constructions, the spring-arms in the disclosed embodiments can be interchanged with that shown or described with respect to other embodiments herein. As noted, although two spring-arms are preferred, the device can also contain only one spring arm. Here, a spring-arm member 4000' is provided that is made from a single U-shaped member having arms 4010' and 4020'. The spring-arm member 4000' can be fixed to the block 4050' in a variety of ways. For example, a hole 4001' can be formed in the member 4050' and a clamping member 4002' (shown in dashed lines) can be positioned therein to clamp the spring-arm to the surface of the member 4050' at the proximal end 4002' of the spring-arm. As one example, the clamping member 4002' can include a nut having a head portion that clamps the end of the U-shaped spring-arm member 4000 to the block 4050'.

The blocking member 4040' is similar to the member 4040. In the illustrated embodiment, the blocking member 4040' is connected to the block by screws 4042'. The blocking member 4040' can also be welded, glued or otherwise connected thereto. In addition, the blocking member can also be integrally formed as a single piece with the block 4050', e.g., molded, cut or otherwise formed together therewith. As noted, the device shown in FIG. 16(A) can operate in a manner as described above with respect to FIGS. 15(A)–15(C).

Figure 17A:
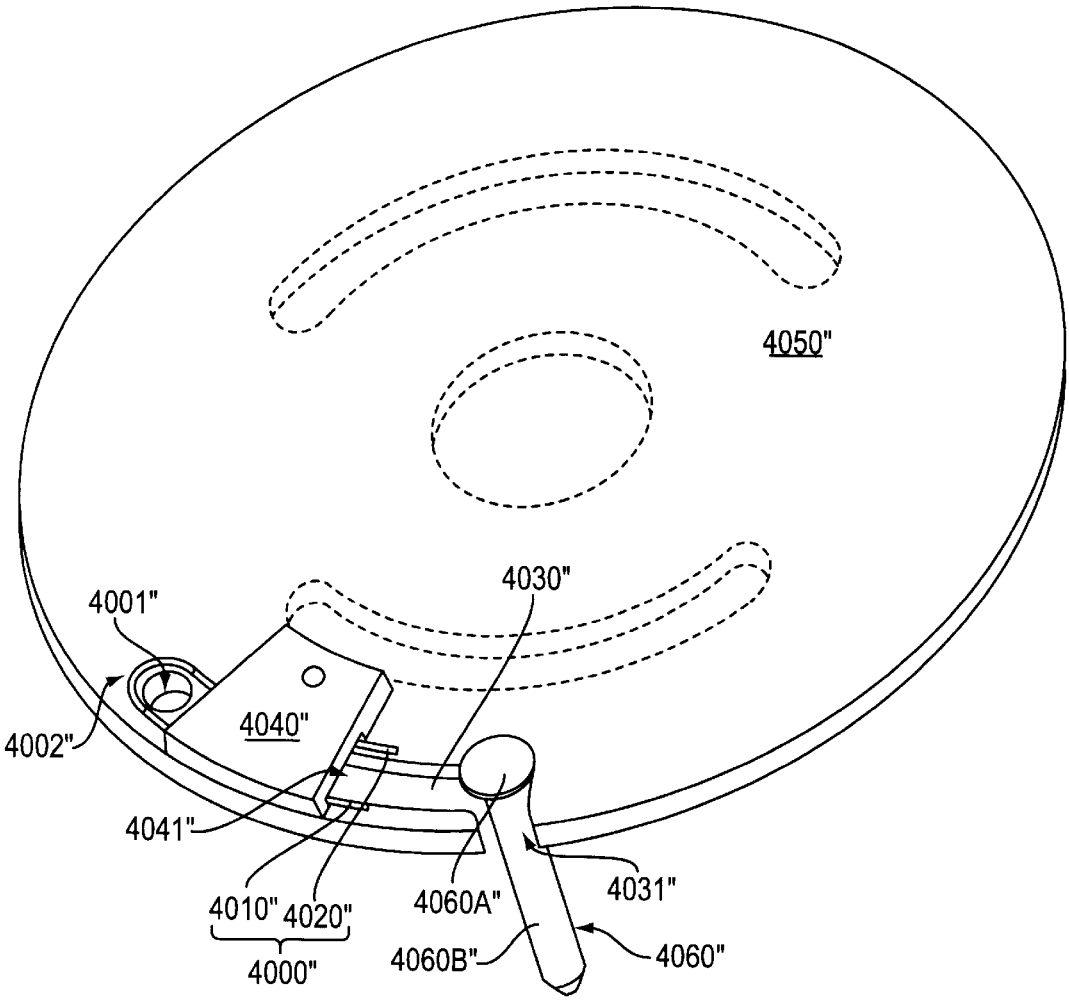
FIG. 17(A) is a perspective view of another embodiment of the anti-tamper device, as shown with a plate member rotating about an axis generally parallel to an axis of the solenoid pin.

FIG. 17(A) shows a third embodiment, which is similar to that shown in first and second embodiments. In this third embodiment, reference numerals include a suffix ("), like numbers show similar structures. The anti-tamper device shown in FIG. 17(A) can operate in a manner as described above with respect to FIGS. 15(A)–15(C). In this third embodiment, the block 4050" is a rotatable member that is prevented from rotating via the head 4060A". The slot 4030" is arcuate in shape so that the pin 4060" fits therein as the member 4050" is rotated.

This embodiment can be used in a variety of devices. In one preferred application, the block 4050" operates as a cam member for moving another element, such as one or more locking bolts. In one preferred example, this embodiment can be employed within a device like that shown in FIGS. 13(A)–13(F). In that case, the device shown in FIG. 17(A) would replace the member 2050, the solenoid structure and the re-locking device.

Upon electronic authorization, the solenoid pin 4060" is moved such that the head 4060A" is drawn against the surface of the block 4050". Under this condition, if the member block 4050" is rotated, e.g., via a key, the solenoid blocker 4040", spring-arm member 4000", and pin 4060" operate in a manner similar to that described above with respect to the first and second embodiments. Thus, if an individual attempts to open the lock without proper electronic authorization, the head of the solenoid pin will strike the solenoid blocker 4040" at a position above the channel 4041", preventing the block 4050" from rotating to the position that allows access.

Figure 16C:
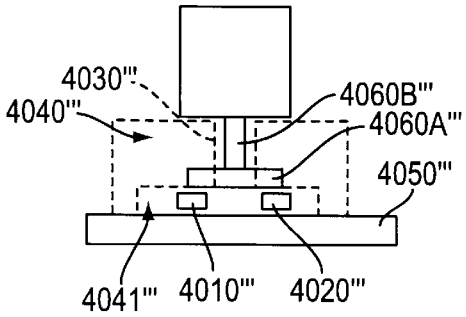
FIG. 16(C) is a side view of an anti-tamper device according to another embodiment of the invention.

FIG. 16(C) illustrates a less preferred alternative of the embodiment shown in FIG. 16(A), wherein the solenoid pin 4060'" does not extend through a slot in the block 4050'". Here, the block 4040'" includes a slot 4030'" to receive the solenoid pin shaft 4060B'" and the solenoid extends the head portion 4060A'" when energized. In other respects, this device operates similar to the above-described embodiments. This alternative construction, wherein the solenoid pin is extended toward the block, can be incorporated in any of the other embodiments disclosed herein.

Figure 17B:
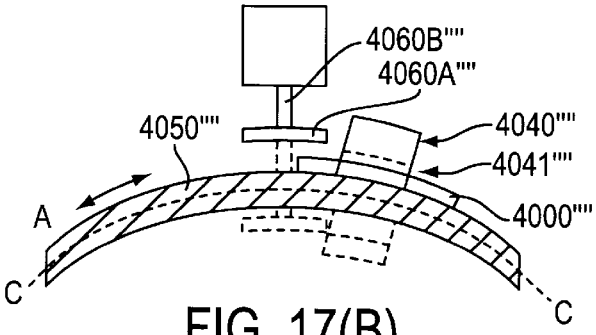
FIG. 17(B) is a side view of another embodiment of the anti-tamper device, as shown with a plate member rotating about an axis generally perpendicular to the axis of the solenoid pin.

FIG. 17(B) shows another embodiment wherein a block 4050"" (shown in cross-section) is moved around an arcuate, or circular, path C—C (see arrows A). Here, the block is rotated around an axis generally perpendicular to the axis of the pin, rather than generally parallel thereto as in the embodiment shown in FIG. 17(A). FIG. 17(B) also illustrates the use of alternatives with the solenoid blocker 4040"" on the same side as the solenoid (solid lines), and on an opposite side therefrom (dashed lines). Operation of this embodiment is also similar to that of the above embodiments.

Although a solenoid is preferred, another important alternative that can be used to modify any of the above-discussed preferred embodiments is that the use of a solenoid to move the pin (e.g., 4060, 4060', . . . ) can be eliminated, and the pin can be moved by another known electronic moving means. As one example, a small electric motor can move the pin in a first direction when the motor is energized, while a biasing member, such as a spring, can return the pin to a locked position when the motor is de-energized.

Another preferred electric moving means includes the use of specific materials that can be used to impart movement by an electrical source.

In one preferred embodiment, the actuator mechanism, that moves the pin (4060, 4060', . . . ) can include a length of shape memory alloy material (one example of which is NITINOL wire) attached to the pin and electrically coupled to the controller device. Shape memory alloy is a material which can be set to deform when heated. For example, a length of NITINOL(tm) wire may be formed such that upon heating, such as by passing a small amount of current through the NITINOL wire, the wire will contract, causing the pin to be moved to the unblocking position, allowing the block to be moved accordingly.

NITINOL is a shape memory alloy material (made of a NiTi alloy) which undergoes a crystalline phase change when heated, causing it to contract or to expand, depending on whether the material is pre-stressed to be in a compressed state or a stretched state. The phase change occurs almost instantaneously at a specific temperature, which can be specified in commercial grades of NITINOL wire. NITINOL wire is commercially available, for example from Dynalloy, Inc. under the trade name FLEXINOL.

While the use of NITINOL is described as a shape memory alloy material for purposes of illustration of a preferred embodiment of the invention, it will be noted that the present invention is not limited to the use of NITINOL, but may be implemented by using any other appropriately suitable material. Examples of other known shape memory alloy materials include Cu—Al—Ni, Fe—Mn—Si—Cr—Ni, and Cu50—Zr50. Shape memory alloy materials are also commercially available from Shape Memory Applications, Inc., Santa Clara, Calif.

Figure 4:
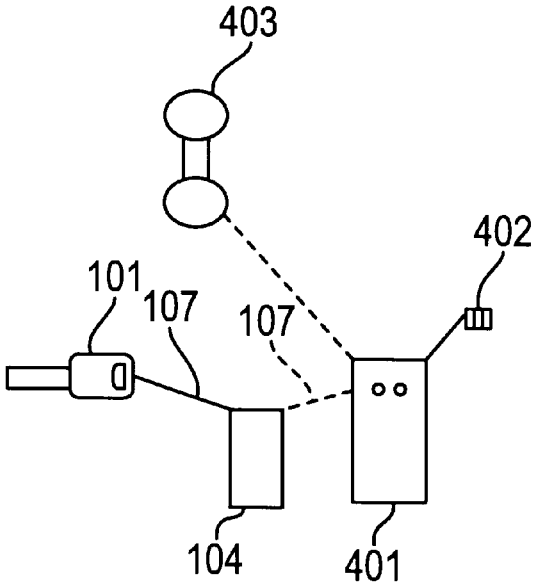
FIG. 4 is a schematic view of another embodiment of a portable key programmer.
Figure 5:
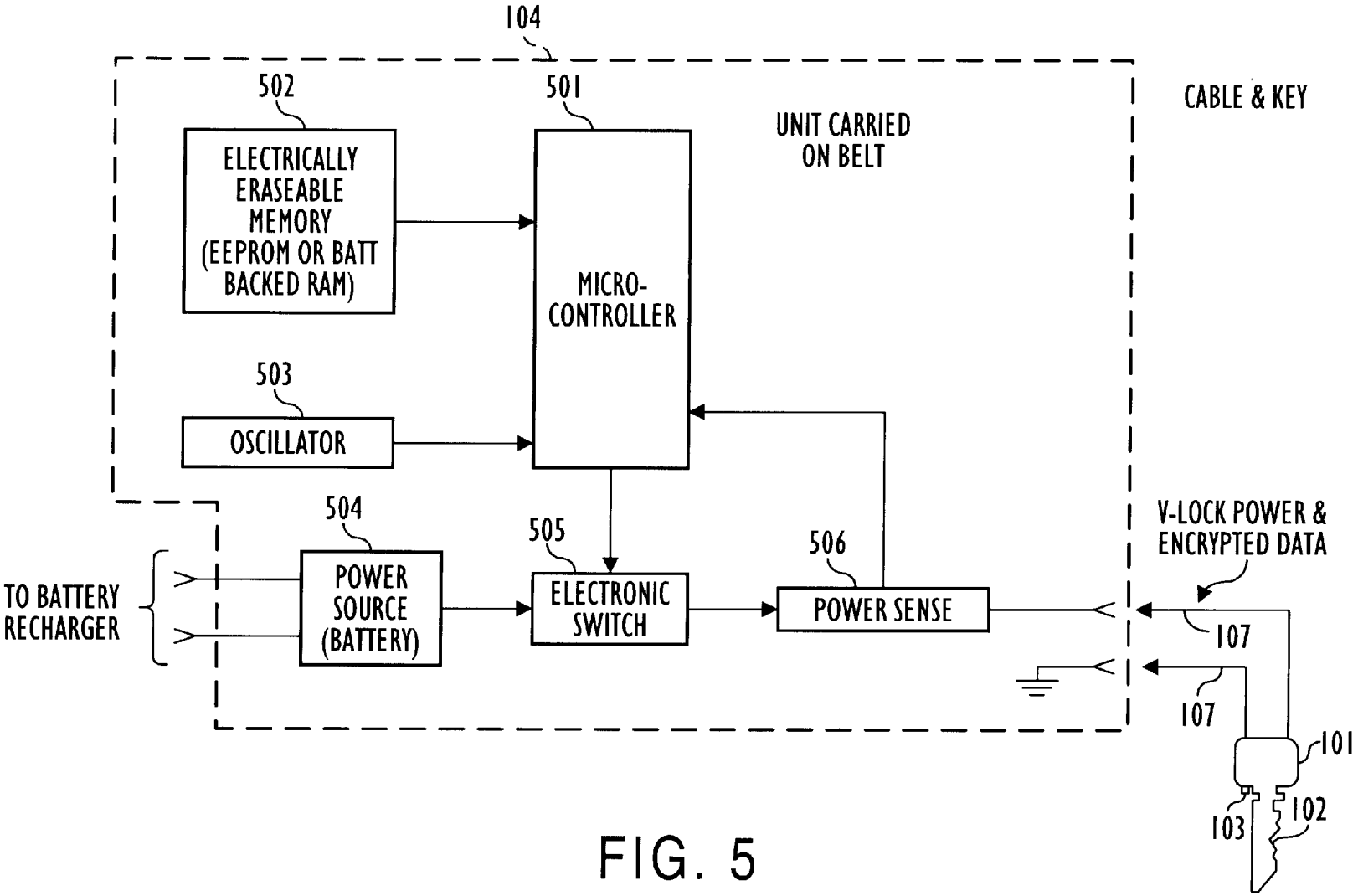
FIG. 5 is a schematic block diagram of the circuit elements of the electronic key of FIG. 1A.
Figure 6:
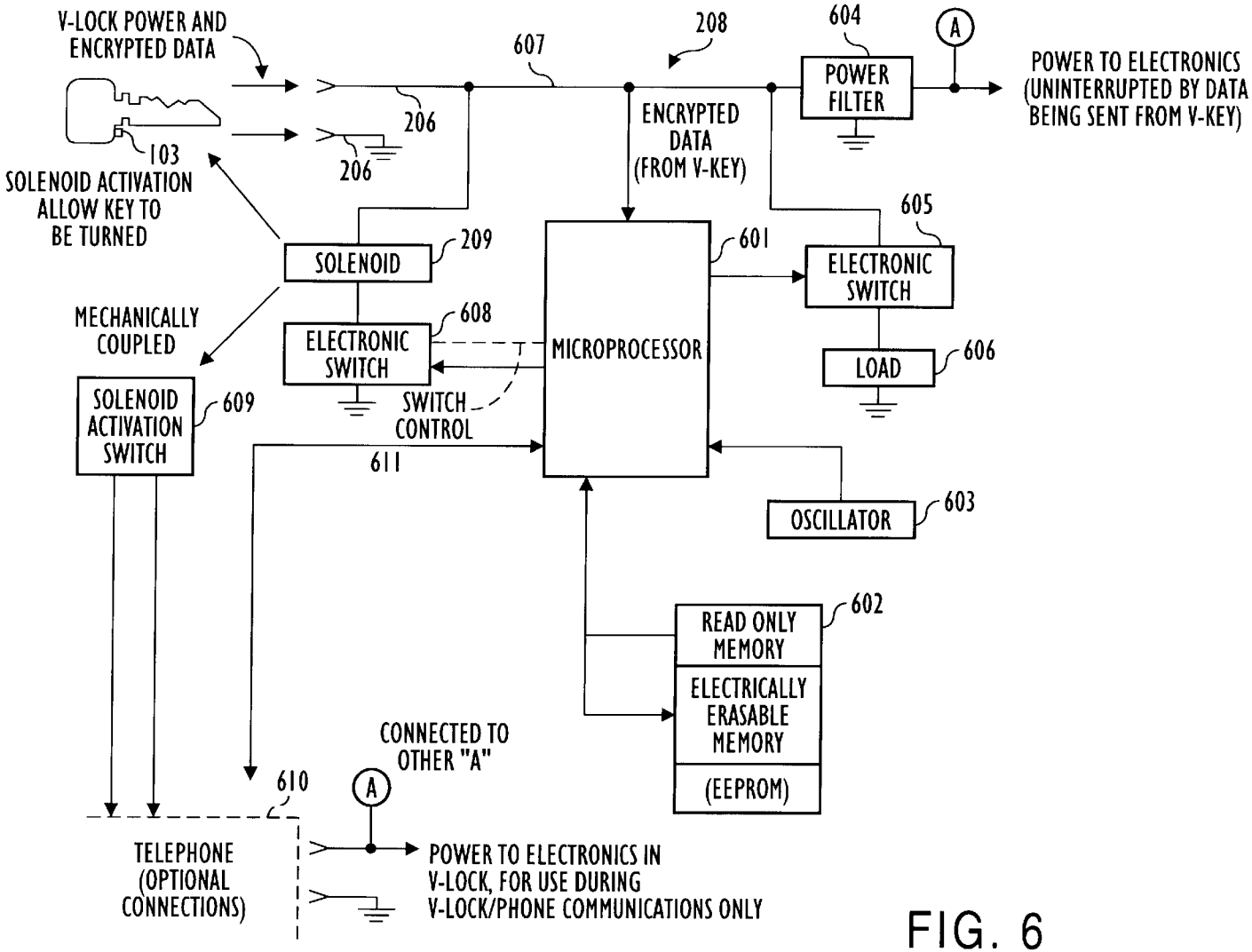
FIG. 6 is a schematic block diagram of the electronic components of the lock mechanism of FIG. 2.
Figure 7:
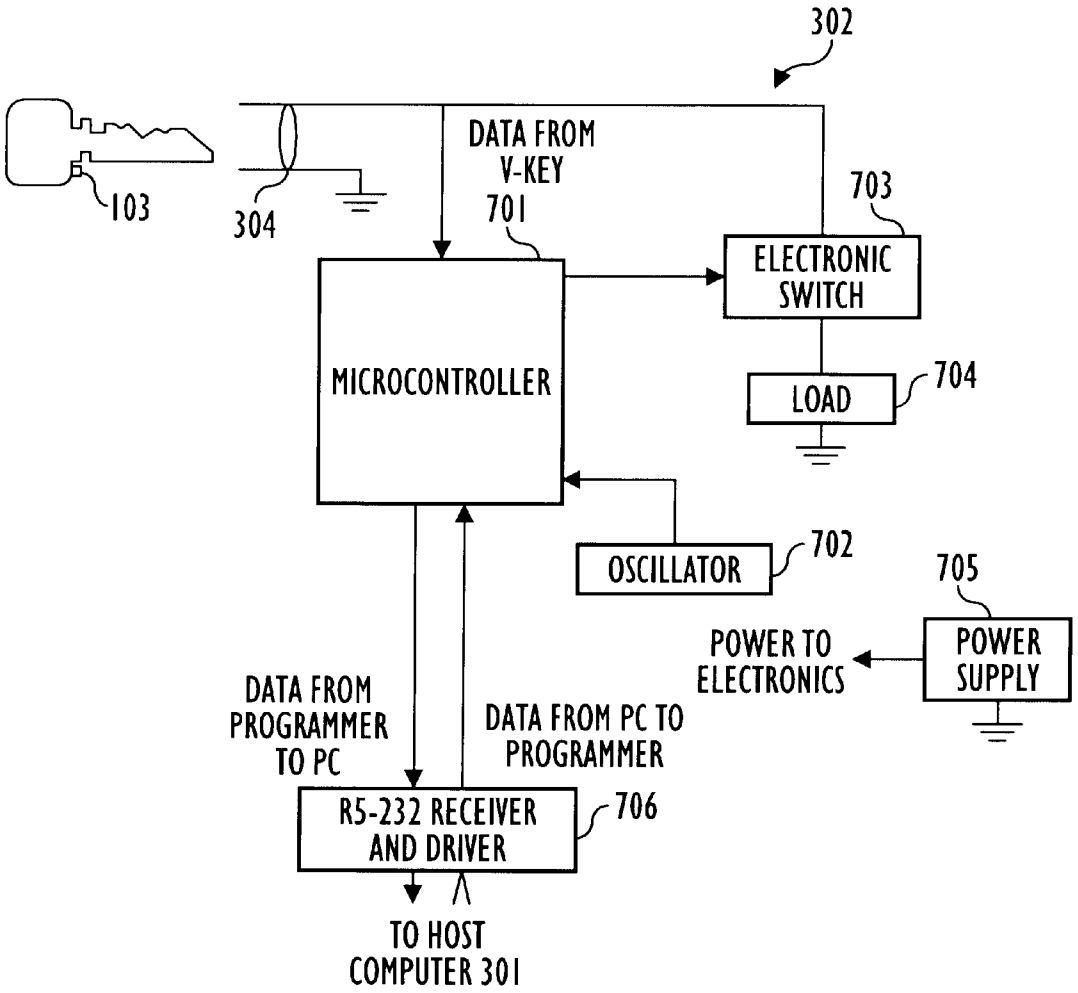
FIG. 7 is a schematic block diagram of the electronic key programmer of FIGS. 3 and 4.
Figure 8:
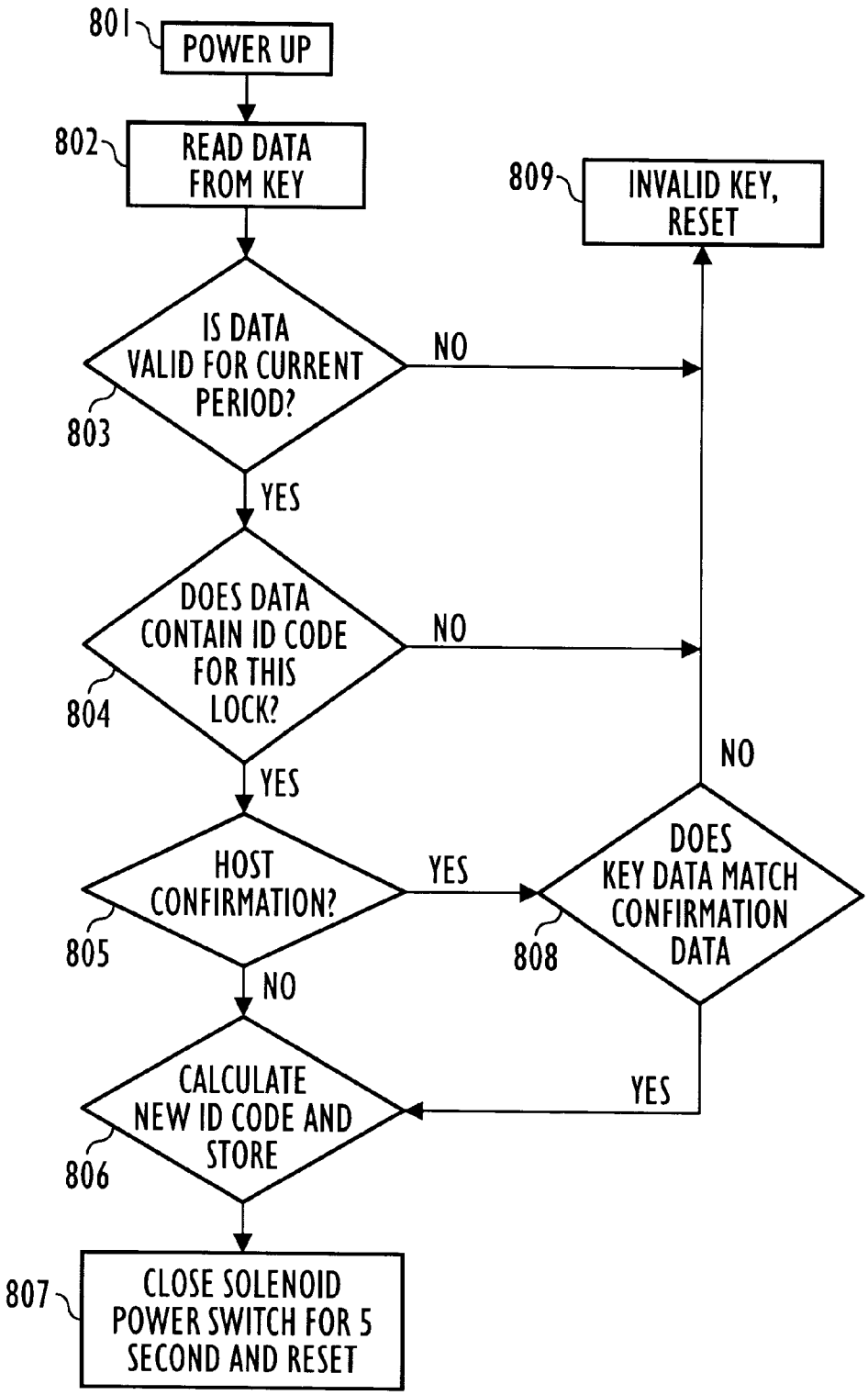
FIG. 8 is an operational flow chart diagram of the electronic lock mechanism operation.
Figure 9:
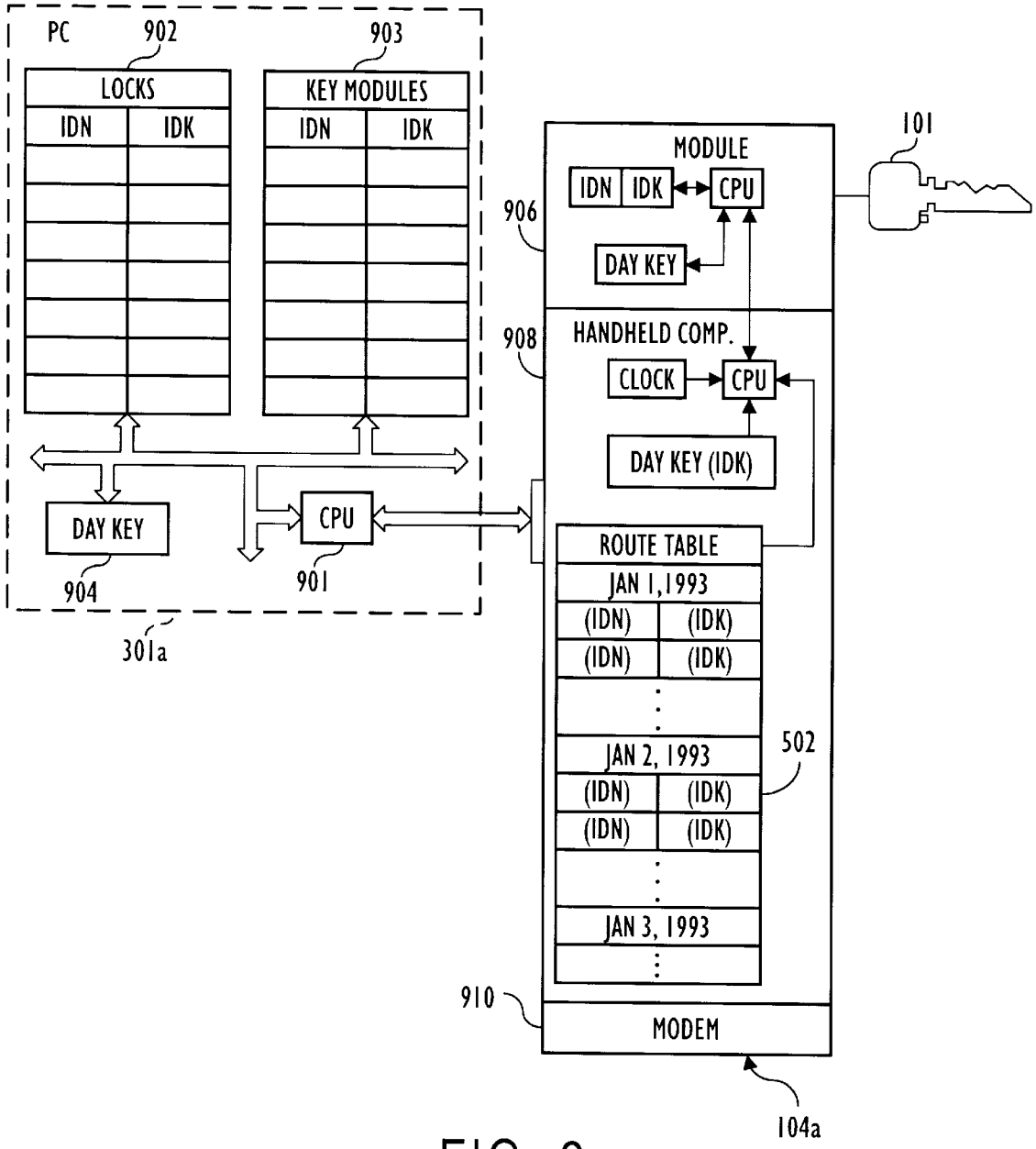
FIG. 9 is a schematic block diagram of an electronic key programmer and an electronic key unit according to a second embodiment.
Figure 10:
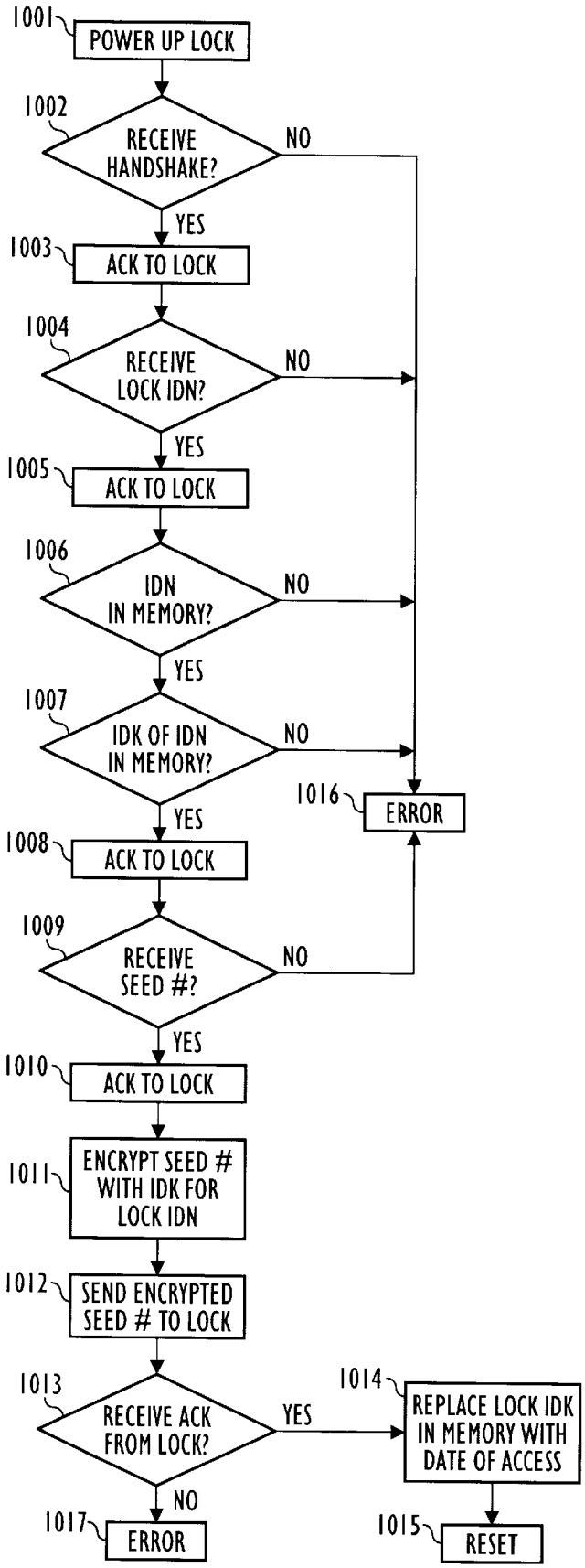
FIG. 10 is a flow chart diagram of the operation of the key unit 104*a* of FIG. 9.
Figure 10A:
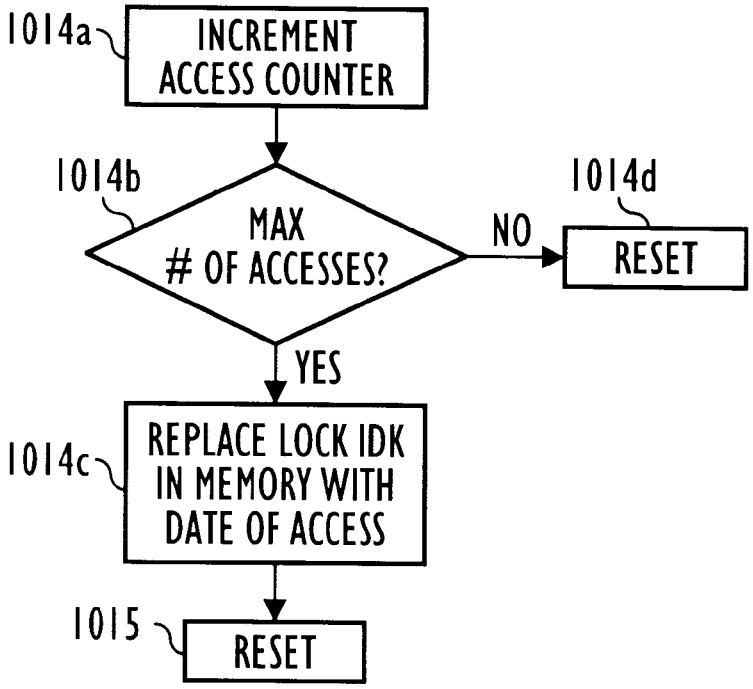
FIG. 10A is a flow chart diagram of an alternative routine for step 1014 of FIG. 10.
Figure 11:
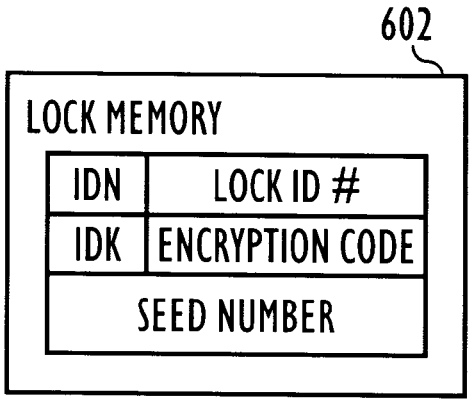
FIG. 11 is block diagram of the contents of lock memory 602 according to the second embodiment.
Figure 12:
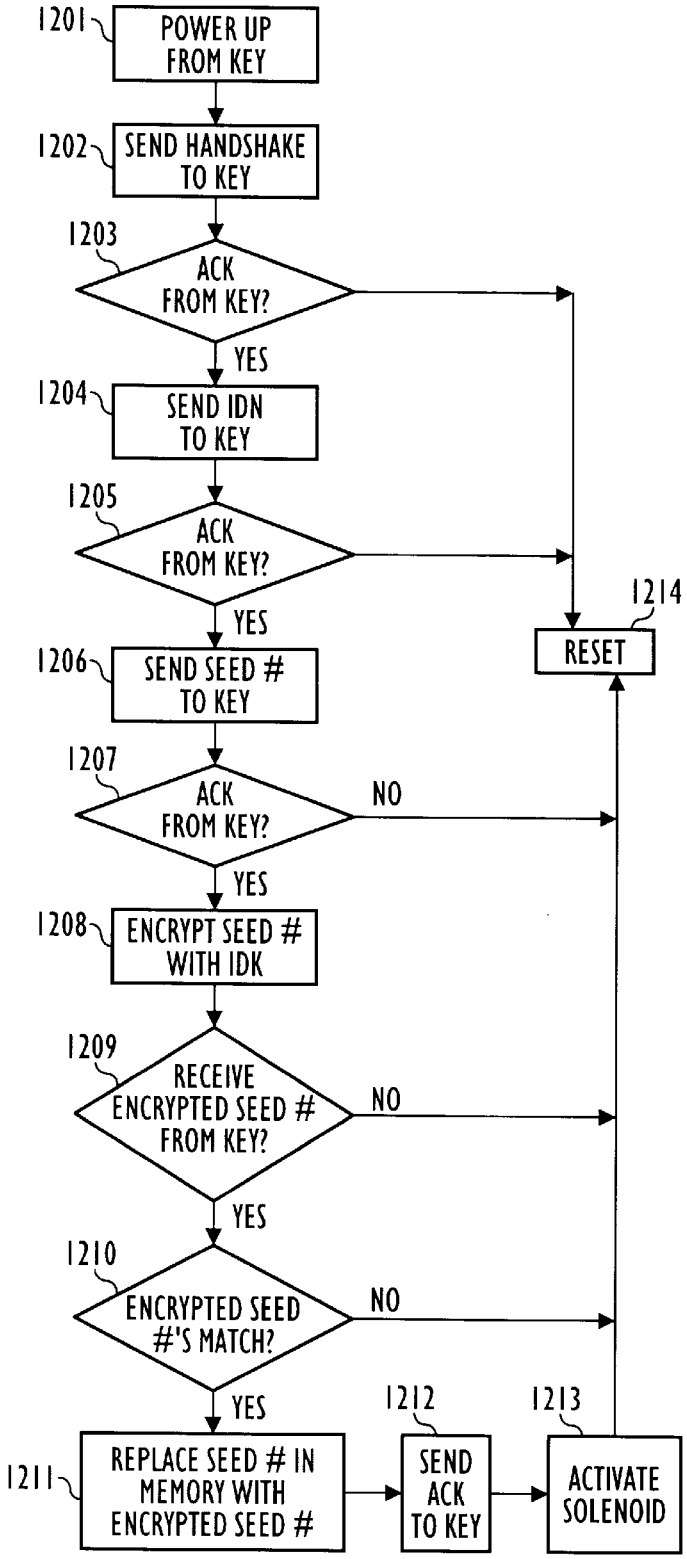
FIG. 12 is a flow chart diagram of the operation of the lock unit 201 according to the second embodiment.
Figure 13A:
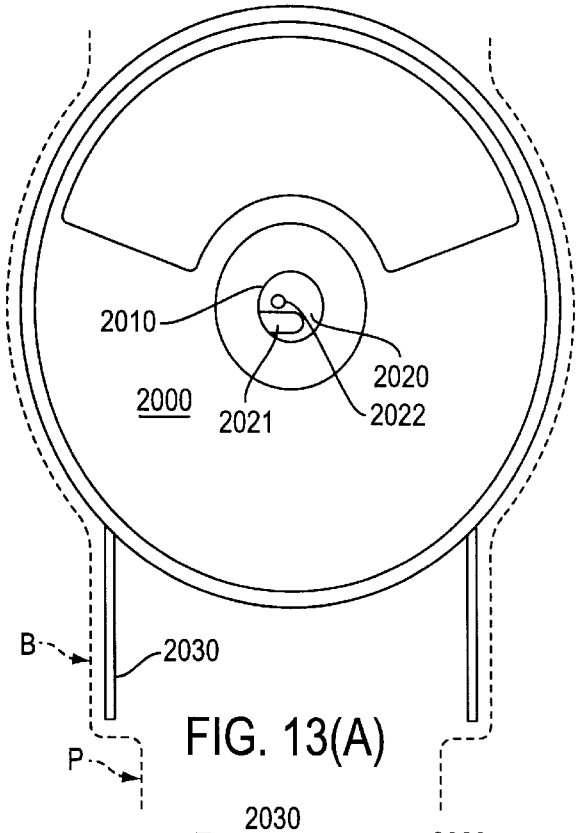
FIG. 13(A) is a front view of a vault door on a parking meter according to a first embodiment.
Figure 13B:
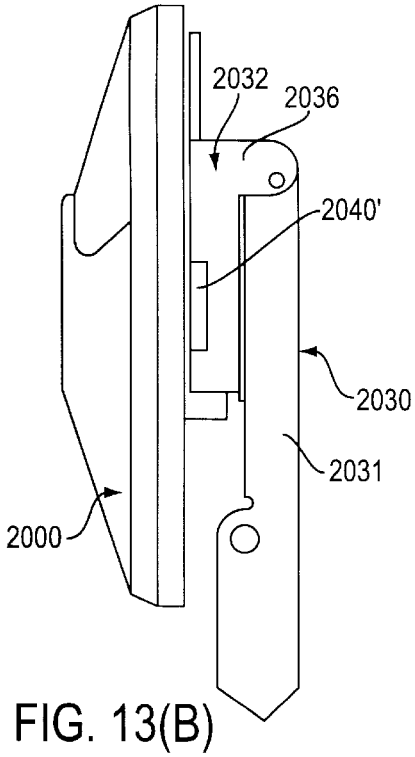
FIG. 13(B) is a side view from the right side in FIG. 13(A) showing the mounting structure of the vault door.
Figure 13C:
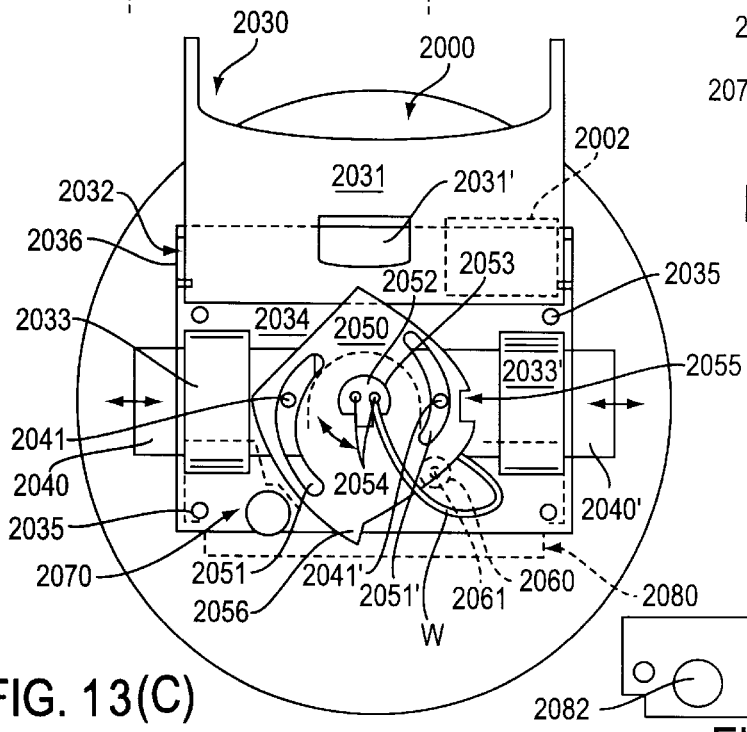
FIG. 13(C) is a rear view of the vault door shown in FIG. 13(A) with the mounting bracket pivoted upward to show the electronic lock features thereof.
Figure 13D:
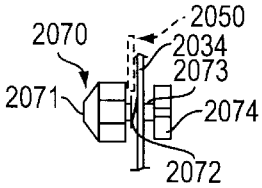
FIG. 13(D) is a side view of the preferred re-locking device shown in FIG. 13(C)
Figure 13E:
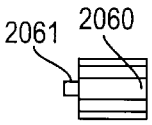
FIG. 13(E) is a side view of the solenoid shown in FIG. 13(C)
Figure 13F:
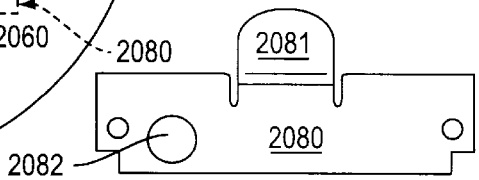
FIG. 13(F) is a top view of a cover plate that is preferably mounting over the rear of the vault door shown in FIG 13(C)
Figure 13G:
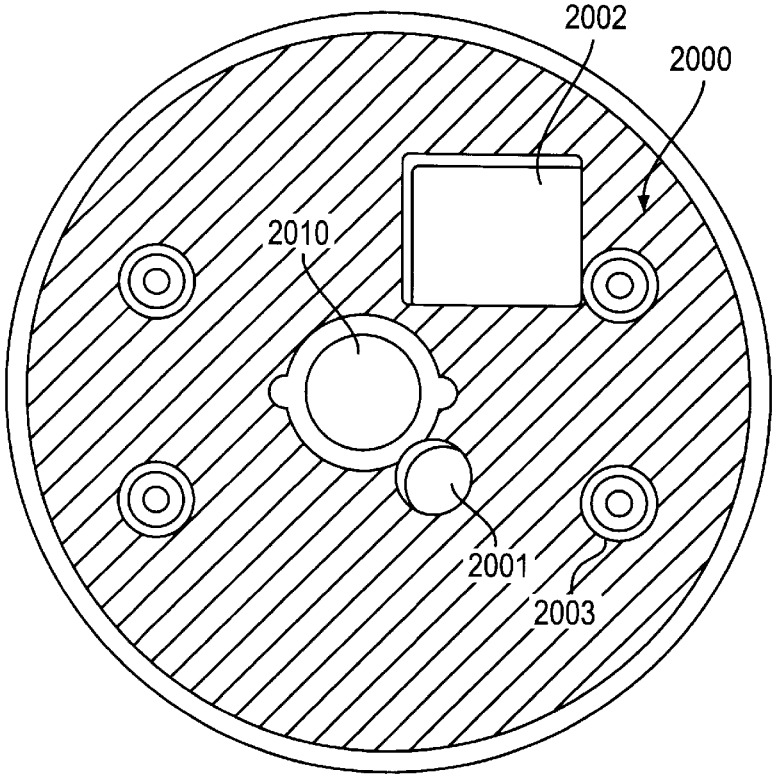
FIG. 13(G) is a rear view of the vault door shown in FIG. 13(A) with the mounting bracket and lock structure removed therefrom.
Figure 13H:
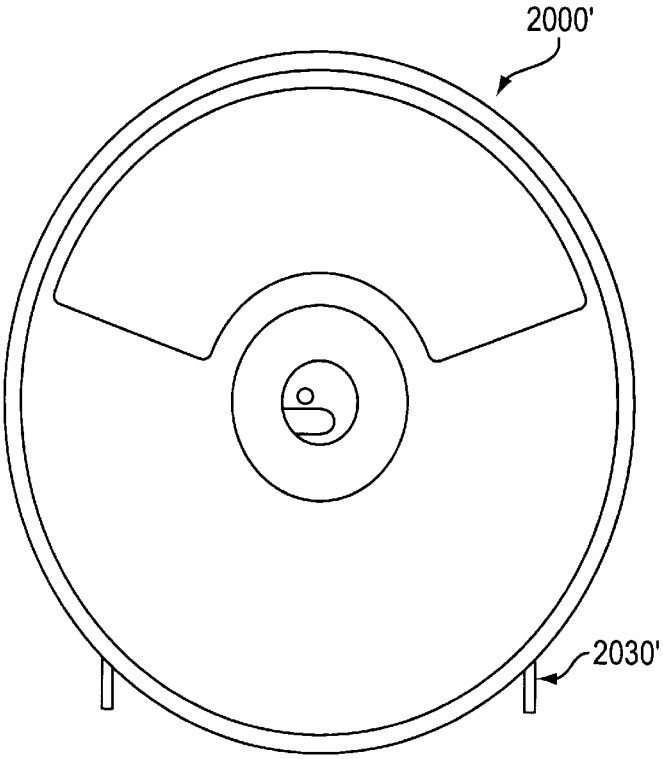
FIGS. 13(H)–13(I) show another embodiment of a vault door having a different mounting bracket structure.
Figure 13I:
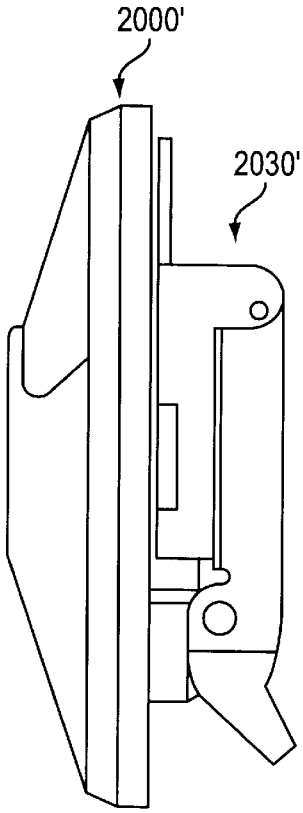

As another example, the pin could be moved by way of nickel-titanium wire which can shrink when an electrical current passes therethrough. The nickel-titanium wire can be attached to a return spring in a manner like that disclosed in U.S. Pat. No. 5,351,042, the entire disclosure of which is incorporated herein by reference (see, e.g., FIG. 4), such that the pin can be moved to engage and disengage the block as desired.

Most preferably, the pin is in a locked position in the un-energized state of the electric moving means (e.g., solenoids, electromagnets, electrically shrinkable or movable materials, electric motors, etc.) and is moved into an unlocking state upon energization. Although less preferred, the pin could also be moved to an unlocking position upon de-energization, depending on the circuitry provided.

The invention being thus described, it will be apparent to those skilled in the art that the same may be varied in many ways without departing from the spirit and scope of the invention. Any and all such modifications are intended to be included within the scope of the following claims.

What is claimed is:

1. An anti-tamper locking assembly for locking a position of a block, comprising:

an electrical moving means, selectively activated by an electronic circuit, for moving a pin that is normally maintained in a first position in an un-energized state of said moving means to a second position in an energized state of said moving means, said pin having an overhanging portion that extends laterally from at least one side of said pin;

a block mounted to move along a path passing transverse to an axis of said pin;

said block having a pin blocker extending outward from a side of said block;

said block having at least one spring-arm mounted thereto, said spring-arm being normally maintained in a first position near said axis of said pin and being moveable in a direction away from said axis of said pin;

wherein in an un-energized state of said moving means a) when said block is moved along said path to an adjacent position whereat said pin is adjacent said pin blocker, said overhanging portion abuts said pin blocker and a surface of said spring-arm is positioned to block said overhanging portion to prevent said pin from being forced to a position wherein the overhanging portion does not abut said pin blocker, and wherein in an energized state of said moving means a) said overhanging portion is moved to a position whereat when said block is moved along said path, said overhanging portion abuts said spring-arm to cause said spring-arm to move laterally away from the axis of said pin and b) said overhanging portion is positioned so as to pass said pin blocker when said block is moved along said path past said adjacent position.

2. The assembly of claim 1, wherein said pin extends through a slot in said block, said moving means is on a first side of said block and said overhanging portion of said pin is a head portion located on a second side of said block opposite to said first side, and wherein when said moving means is energized, said head portion is drawn towards a surface of said block.

3. The assembly of claim 2, wherein said spring-arm includes at least one elongated rod located along a side of said slot and normally positioned so as to be locatable beneath said head portion of said pin.

4. An electronic lock having an anti-tamper locking assembly for locking a position of a block within the lock, comprising:

an electrical moving means, selectively activated by an electronic circuit, for moving a pin that is normally maintained in a first position in an un-energized state of said moving means to a second position in an energized state of said moving means, said pin having an overhanging portion that extends laterally from at least one side of said pin;

a block mounted to move along a path passing transverse to an axis of said pin;

said block having a pin blocker extending outward from a side of said block;

said block having at least one spring-arm mounted thereto, said spring-arm being normally maintained in a first position near said axis of said pin and being moveable in a direction away from said axis of said pin;

wherein in an un-energized state of said moving means a) when said block is moved along said path to an adjacent position whereat said pin is adjacent said pin blocker, said overhanging portion abuts said pin blocker and a surface of said spring-arm is positioned to block said overhanging portion to prevent said pin from being forced to a position wherein the overhanging portion does not abut said pin blocker, and wherein in an energized state of said moving means a) said overhanging portion is moved to a position whereat when said block is moved along said path, said overhanging portion abuts said spring-arm to cause said spring-arm to move laterally away from the axis of said pin and b) said overhanging portion is positioned so as to pass said pin blocker when said block is moved along said path past said adjacent position.

5. The electronic lock of claim 4, wherein said pin extends through a slot in said block, said moving means is on a first side of said block and said overhanging portion of said pin is a head portion located on a second side of said block opposite to said first side, and wherein when said moving means is energized, said head portion is drawn towards a surface of said block.

6. The electronic lock of claim 5, wherein said spring-arm includes at least one elongated rod located along a side of said slot and normally positioned so as to be locatable beneath said head portion of said pin.

7. The electronic lock of claim 4, wherein said block has a generally flat surface, said axis of said pin being generally perpendicular to said generally flat surface.

8. The electronic lock of claim 7, wherein said block is linearly reciprocatable in a first plane generally parallel to said flat surface.

9. The electronic lock of claim 8, wherein said block is a locking bolt that releases a door of said electronic lock when moved to a release position.

10. The electronic lock of claim 4, wherein said block is rotatably mounted about an axis.

11. The electronic lock of claim 10, wherein said block is a cam member that moves at least one locking bolt so as to release a door of said electronic lock when said cam member is moved to a release position.

12. The electronic lock of claim 4, wherein said moving means includes a solenoid.

13. The electronic lock of claim 4, wherein said moving means includes a shape memory alloy.

14. The electronic lock of claim 4, wherein said moving means includes a magnet.

15. The electronic lock of claim 6, wherein said elongated rod has a generally circular cross-section.

16. The electronic lock of claim 6, wherein said elongated rod has a generally rectangular cross-section.

17. The electronic lock of claim 4, wherein said pin blocker is a separate member that is fixed to a surface of said block.

18. The electronic lock of claim 4, wherein said pin blocker is integrally formed as a single member with said block.

19. An electronic security lock having an anti-tamper locking assembly for locking the position of a block that opens the lock, comprising:

an electrical moving means, selectively activated by an electronic circuit, for moving a pin that is normally maintained in a first position in an un-energized state of said moving means to a second position in an energized state of said moving means; and a block mounted to move along a path passing transverse to an axis of said pin;

wherein in said first position, said pin is located within said path so as to prevent said block from moving along said path past said pin;

said lock further comprising means for limiting the net distance of travel of said pin in a direction parallel to an axis of said pin and toward said second position, which travel is caused to occur by striking an outer housing of said lock, such that said block is prevented from moving past the axis of said pin;

wherein said means for limiting said pin from moving includes: said block having a pin blocker extending outward from a side of said block; said block having at least one spring-arm mounted thereto, said spring-arm being normally maintained in a first position near said axis of said pin and being moveable in a direction away from said axis of said pin; wherein in an un-energized state of said moving means a) when said block is moved along said path to an adjacent position whereat said pin is adjacent said pin blocker, an overhanging portion abuts said pin blocker and a surface of said spring-arm is positioned to block said overhanging portion to prevent said pin from being forced to a position wherein the overhanging portion does not abut said pin blocker, and wherein in an energized state of said moving means a) said overhanging portion is moved to a position whereat when said block is moved along said path, said overhanging portion abuts said spring-arm to cause said spring-arm to move laterally away from the axis of said pin and b) said overhanging portion is positioned so as to pass said pin blocker when said block is moved along said path past said adjacent position.

20. The electronic security lock of claim 19, wherein said means for limiting said pin from moving includes: a support pole having a vertical axis, said housing being fixedly mounted on said pole, said pin having a vertical axis that is parallel to said axis of said vertical pole, whereby said pin is prevented from moving to said second position due to said pole which is located along said vertical axis so as to prevent vertical motion of said housing upon striking said housing.

21. The electronic security lock of claim 19, wherein said block includes a rotated cam member.

22. The electronic security lock of claim 19, wherein said block includes a rotated cam member that rotates around a generally horizontal axis.

23. The electronic security lock of claim 22, wherein said block includes a wall that extends laterally from the cam member and that is arranged to engage with said pin when said pin is in said first position.

24. The electronic security lock of claim 21, wherein said electronic security lock is a parking meter lock.

25. The electronic security lock of claim 23, wherein said electronic security lock is a parking meter lock.

* * * * *